US011959713B2

(12) United States Patent
Davis et al.

(10) Patent No.: US 11,959,713 B2
(45) Date of Patent: Apr. 16, 2024

(54) FIREARM FIRE CONTROL GROUP

(71) Applicant: Exponential Innovation IP Holdings LLC, Freehold, NJ (US)

(72) Inventors: Von Davis, Freehold, NJ (US); Daniel R. Blackburn, Jacksonville, FL (US)

(73) Assignee: Exponential Innovation IP Holdings LLC, Freehold, NJ (US)

( * ) Notice: Subject to any disclaimer, the term of this patent is extended or adjusted under 35 U.S.C. 154(b) by 114 days.

(21) Appl. No.: 17/853,145

(22) Filed: Jun. 29, 2022

(65) Prior Publication Data

US 2023/0097725 A1 Mar. 30, 2023

Related U.S. Application Data

(60) Provisional application No. 63/216,736, filed on Jun. 30, 2021.

(51) Int. Cl.

| | |
|---|---|
| ***F41A 19/45*** | (2006.01) |
| ***F41A 17/46*** | (2006.01) |
| ***F41A 19/10*** | (2006.01) |

(52) U.S. Cl.

CPC ..... *F41A 19/45* (2013.01); *F41A 17/46* (2013.01); *F41A 19/10* (2013.01)

(58) Field of Classification Search

CPC ..... F41A 19/45; F41A 17/46; F41A 19/10

See application file for complete search history.

(56) References Cited

U.S. PATENT DOCUMENTS

| | | | | |
|---|---|---|---|---|
| 4,023,465 | A | 5/1977 | Inskip | |
| 4,522,106 | A * | 6/1985 | Sullivan | F41A 19/43 89/154 |
| 4,594,934 | A | 6/1986 | Holstein et al. | |
| 5,501,134 | A | 3/1996 | Milazzo et al. | |
| 5,924,231 | A * | 7/1999 | Kidd | F41A 19/44 42/42.03 |
| 6,722,072 | B1 * | 4/2004 | McCormick | F41A 19/43 42/75.03 |
| 6,772,548 | B1 * | 8/2004 | Power | F41A 19/10 89/139 |
| 7,162,824 | B1 * | 1/2007 | McCormick | F41A 19/43 42/75.03 |
| 7,293,385 | B2 * | 11/2007 | McCormick | F41A 19/12 |
| 7,421,937 | B1 * | 9/2008 | Gangl | F41A 19/16 89/142 |
| 7,430,827 | B1 * | 10/2008 | Huber | F41A 19/16 42/69.01 |
| 7,992,335 | B2 * | 8/2011 | Gangl | F41A 19/14 42/69.03 |
| 8,220,193 | B1 | 7/2012 | Lynch | |
| 8,667,881 | B1 | 3/2014 | Hawbaker | |

(Continued)

*Primary Examiner* — Michelle Clement

(74) *Attorney, Agent, or Firm* — Lerner David LLP

(57) ABSTRACT

A fire control group system for a firearm includes a trigger that includes a trigger base, a trigger extension extending from the trigger base, and an over-travel member coupled to the trigger base at a front end thereof. The trigger base has a sear hook extending therefrom and defining a recess and a transverse bore intersecting the recess. The over-travel member has a contact surface and is moveable relative to the trigger base such that a distance in a vertical direction between the contact surface and the trigger base is adjustable.

20 Claims, 17 Drawing Sheets

(56) References Cited

U.S. PATENT DOCUMENTS

| | | | | |
|---|---|---|---|---|
| 8,893,607 | B2 * | 11/2014 | Audibert | F41A 19/14<br>42/69.01 |
| 9,310,150 | B1 * | 4/2016 | Geissele | F41A 19/12 |
| 9,618,288 | B2 * | 4/2017 | Wilson | F41A 19/10 |
| 9,719,744 | B2 * | 8/2017 | Horch | F41A 19/10 |
| 9,803,945 | B2 * | 10/2017 | Audibert | F41A 19/14 |
| 9,869,522 | B2 * | 1/2018 | Larson, Jr. | F41A 19/16 |
| 9,989,327 | B2 * | 6/2018 | Horch | F41A 19/10 |
| 10,337,817 | B2 * | 7/2019 | Wilson | F41A 19/10 |
| 10,480,881 | B2 | 11/2019 | Fellows et al. | |
| 10,605,556 | B2 * | 3/2020 | Larson, Jr. | F41A 17/46 |
| 10,684,087 | B2 * | 6/2020 | Thomele | F41A 19/32 |
| 10,704,853 | B2 * | 7/2020 | Geissele | F41A 19/10 |
| 11,193,726 | B2 * | 12/2021 | Geissele | F41A 19/16 |
| 2007/0051236 | A1 * | 3/2007 | Groves | F41A 19/46<br>89/142 |
| 2014/0366418 | A1 * | 12/2014 | Stakes | F41A 19/10<br>42/69.03 |
| 2016/0178304 | A1 | 6/2016 | Geissele | |

* cited by examiner

FIREARM FIRE CONTROL GROUP

CROSS-REFERENCE TO RELATED APPLICATION

This application claims the benefit of the filing date of U.S. Provisional Patent Application No. 63/216,736, filed on Jun. 30, 2021, the disclosure of which is hereby incorporated herein by reference.

BACKGROUND

The Kalashnikov family of firearms may be the most ubiquitous in the world and includes various models of rifles, pistols, shotguns, and machine guns, such as the AK-47, AKM, AK-74, SVD-63, Saiga-12, PP-19 Bizon, RPK, and PKM, for example. The ubiquity of Kalashnikovs the world over is at least partially attributed to their high reliability and low cost of manufacture. For example, Kalashnikov firearms are typically made from stamped metal parts and have relatively loose tolerances which allows them to be operated in extreme conditions without failure and mass produced in countries without access to significant resources and advanced manufacturing practices. However, the tradeoff is that Kalashnikov firearms are generally considered to lack accuracy compared to other firearms in their respective classes. Customized or high precision parts made from ideal materials can enhance their accuracy and extend the longevity of performance. However, since many of these firearms are manufactured in several different countries by different manufacturers, there may be dimensional and material variations even among the same model of firearm that can limit the universal application of such aftermarket parts. Therefore, further improvements are desirable.

BRIEF SUMMARY OF THE INVENTION

In one aspect of the present disclosure, a fire control group system for a firearm includes a trigger that has a trigger base, a trigger extension extending from the trigger base, and an over-travel member coupled to the trigger base at a front end thereof. The trigger base has a sear hook extending therefrom and defining a recess and a transverse bore intersecting the recess. The over-travel member includes a contact surface and is moveable relative to the trigger base such that a distance in a vertical direction between the contact surface and the trigger base is adjustable. A disconnector has a disconnector body and a sear hook that extends from the disconnector body. The disconnector body defines a transverse bore extending therethrough and being configured to be received within the recess of the trigger base so that the transverse bores of the trigger base and disconnector align. A hammer has a spring spool and a hammer body that extends from the spring spool. The spring spool defines a transverse bore extending therethrough. The hammer body has a strike face and a sear that extends from an end of the hammer body. The sear is configured to engage the sear hooks of the trigger and disconnector when coupled to a receiver of a firearm.

In another aspect of the present disclosure, a trigger for a firearm includes a trigger base that has a sear hook extending therefrom. A trigger extension extends from the trigger base. An over-travel member is coupled to the trigger base at a front end thereof. The over-travel member has a contact surface and is moveable relative to the trigger base such that a distance in a vertical direction between the contact surface and the trigger base is adjustable.

In a further aspect of the present disclosure, a pivot pin assembly for a firearm includes a pivot pin that has a head and a shaft. The head has a first threaded opening extending therein and a plurality of expandable members arranged about the first threaded opening. The shaft has a second threaded opening extending therein and a plurality of expandable members arranged about the second threaded opening. First and second screws each having a head and a threaded shaft. The first screw threadedly engages the first threaded opening such that rotating the first screw expands the expandable members of the pivot pin head radially outwardly, and the second screw threadedly engages the second threaded opening such that rotating the second screw expands the expandable members of the pivot pin shaft radially outwardly.

BRIEF DESCRIPTION OF DRAWINGS

The features, aspects, and advantages of the present invention will become better understood with regard to the following description, appended claims, and accompanying drawings in which:

DETAILED DESCRIPTION

Figure 1A:
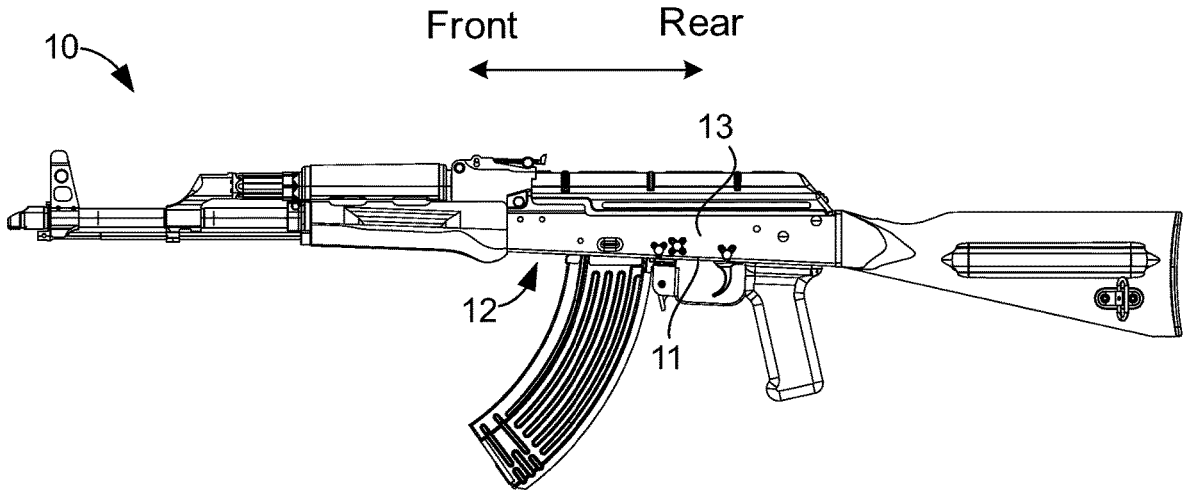
FIG. 1A is a side elevational view of a Kalashnikov firearm.

FIG. 1A depicts an exemplary Kalashnikov firearm 10, in particular, a semi-automatic AK-47 rifle. Firearm 10 includes a receiver 12 which may be made from stamped metal such that it forms a housing that includes receiver sidewalls 13 and a receiver floor 11.

Figure 1B:
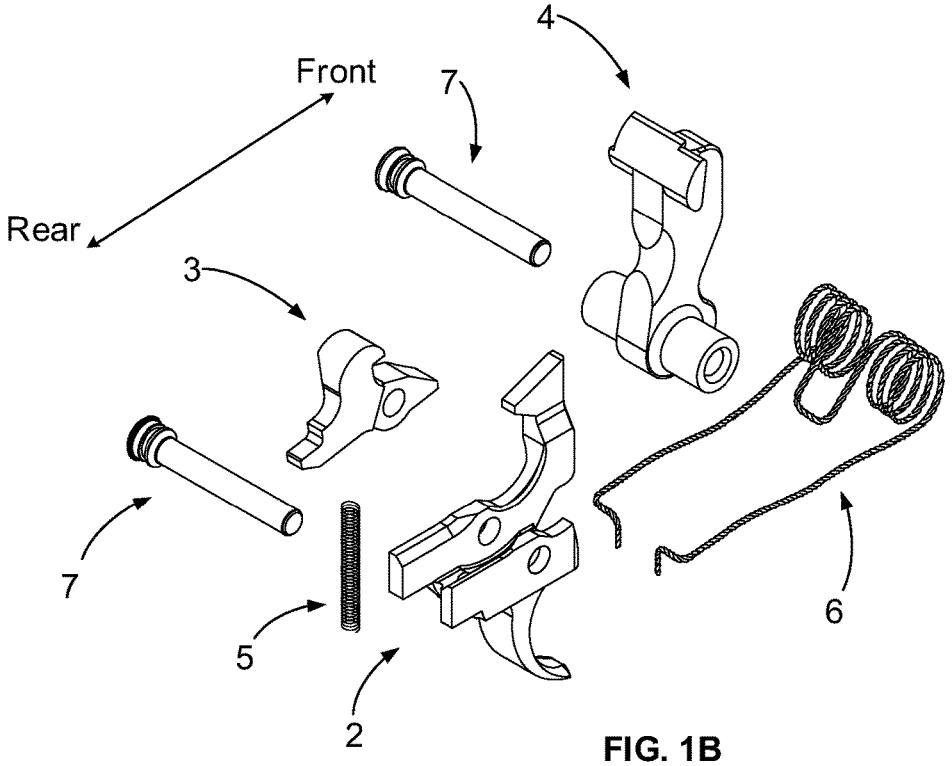
FIG. 1B (Prior Art)
FIG. 1B is an exploded view of a prior art semi-automatic fire control group.
Figure 8A:
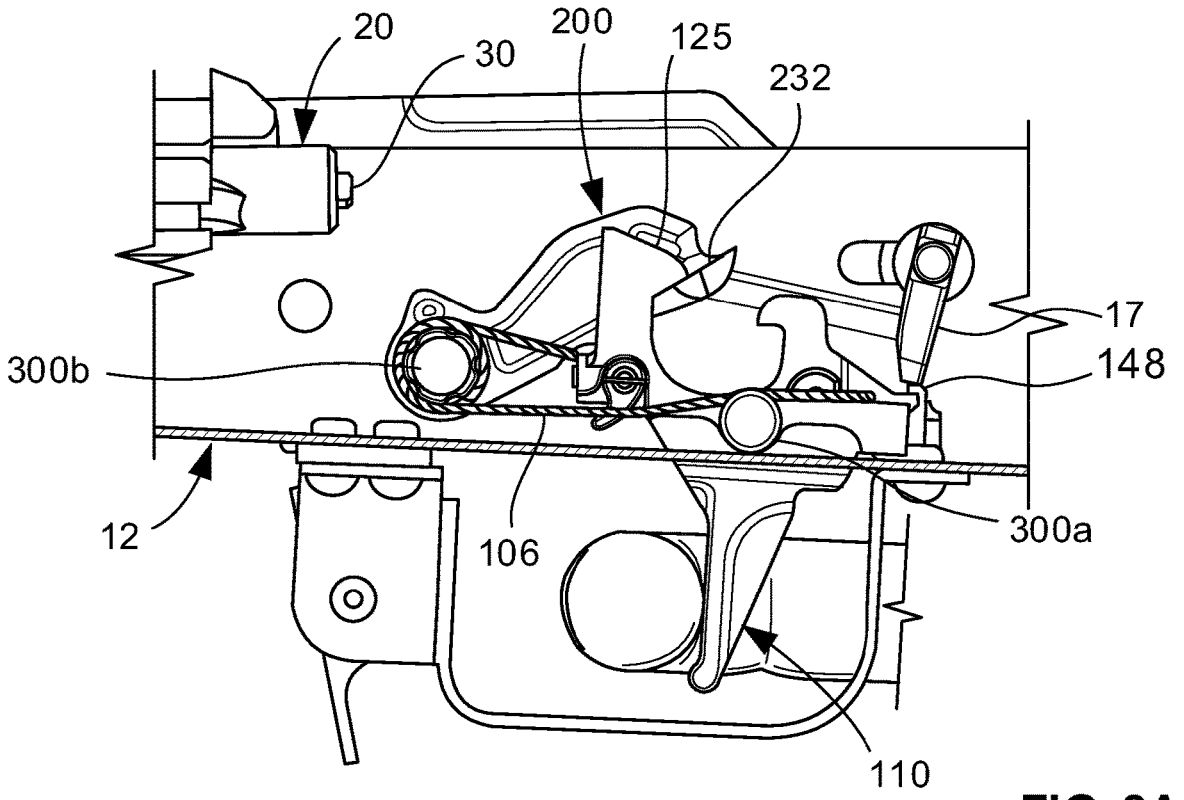
FIGS. 8A-8L depict a method of operations using the fire control group of FIG. 2 in the firearm of FIG. 1A.

FIG. 1B depicts a prior art fire control group which is commonly found in semi-automatic Kalashnikov-style firearms, such as within receiver 12, and is operable to strike a firing pin within a bolt, such as bolt 20 and firing pin 30 shown in FIG. 8A, that is also housed within receiver 12. This fire control group includes a trigger 2, disconnector 3, hammer 4, disconnector spring 5, and hammer spring 6. The fire control group can be coupled to receiver 12 via pivot pins 7 which are received within receiver 12. The fire control group provides baseline functionality for a Kalashnikov-style firearm. However, this baseline functionality generally lacks the characteristics found desirable by those that have limited access to gunsmiths, experienced shooters, those that desire high performance, and those that prefer adjustability.

More specifically, in semi-automatic mode, a trigger pull of a firearm can typically be delineated into several phases that include pre-travel, break, over-travel, and reset. Using the fire control group of FIG. 1B as an example, pre-travel or take-up is generally the amount of rearward movement (i.e., counterclockwise rotation about pin 7 when viewed from a left side of firearm 10) of trigger 2 at it is pulled rearward from the initial (reset/locked) position up until the point in which sear surfaces of hammer 4 and trigger 2 break allowing hammer 4 to release and strike the firing pin 30. Over-travel is generally the amount of rearward movement of trigger 2 as it is continued to be pulled to the rear following the break (i.e., release of the hammer 4) until trigger 2 makes contact with the receiver floor 11 thereby preventing further travel. Reset is the amount of forward movement of trigger 2 (i.e., clockwise rotation about pin 7 when viewed from a left side of firearm 10) from the over-traveled position to the point at which hammer 4 is released from disconnector 3 and reset with trigger 2 for a follow-up shot. Experienced shooters typically prefer minimal movement within each phase of the trigger pull as less movement promotes better accuracy and faster reset. This is generally not the case for the fire control group of FIG. 1B as its structure creates more movement of trigger 2 than what is typically desired. Moreover, while it is generally preferable to limit movement of the trigger, preferences can vary from shooter to shooter. This fire control group cannot accommodate these preferences since the fire control group of FIG. 1B is not adjustable from its baseline functionality, nor can dimensional deviations caused by manufacturers be accounted and corrected.

Figure 2:
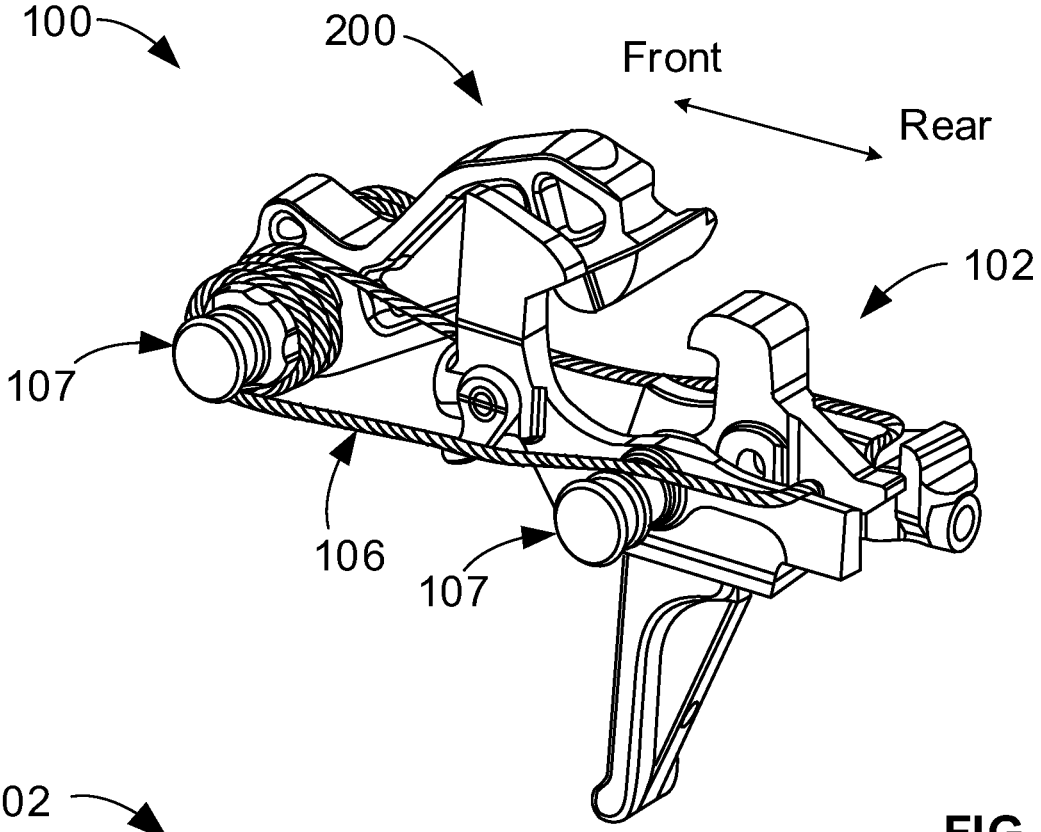
FIG. 2 is a perspective view of a fire control group according to an embodiment of the present disclosure.

FIG. 2 depicts a fire control group 100 according to an embodiment of the present disclosure. Fire control group 100 is adjustable so that it can be utilized in a wide array of firearms and can provide the user their desired feel and performance. Fire control group 100 generally includes a trigger assembly 102, hammer spring 106, pivot pins 107, and hammer 200. Pivot pins 107 secure trigger assembly 102 and hammer 200 to firearm receiver 12 while facilitating rotational movement of the individual components about axes defined by pins 107.

FIGS. 3A-3H depict trigger assembly 102. Trigger assembly 102 generally includes a trigger 104, disconnector 130, and disconnector spring 108. Trigger 104 generally includes a trigger extension 110, trigger base 120, safety engagement member 140, and over-travel member 160.

Figure 3A:
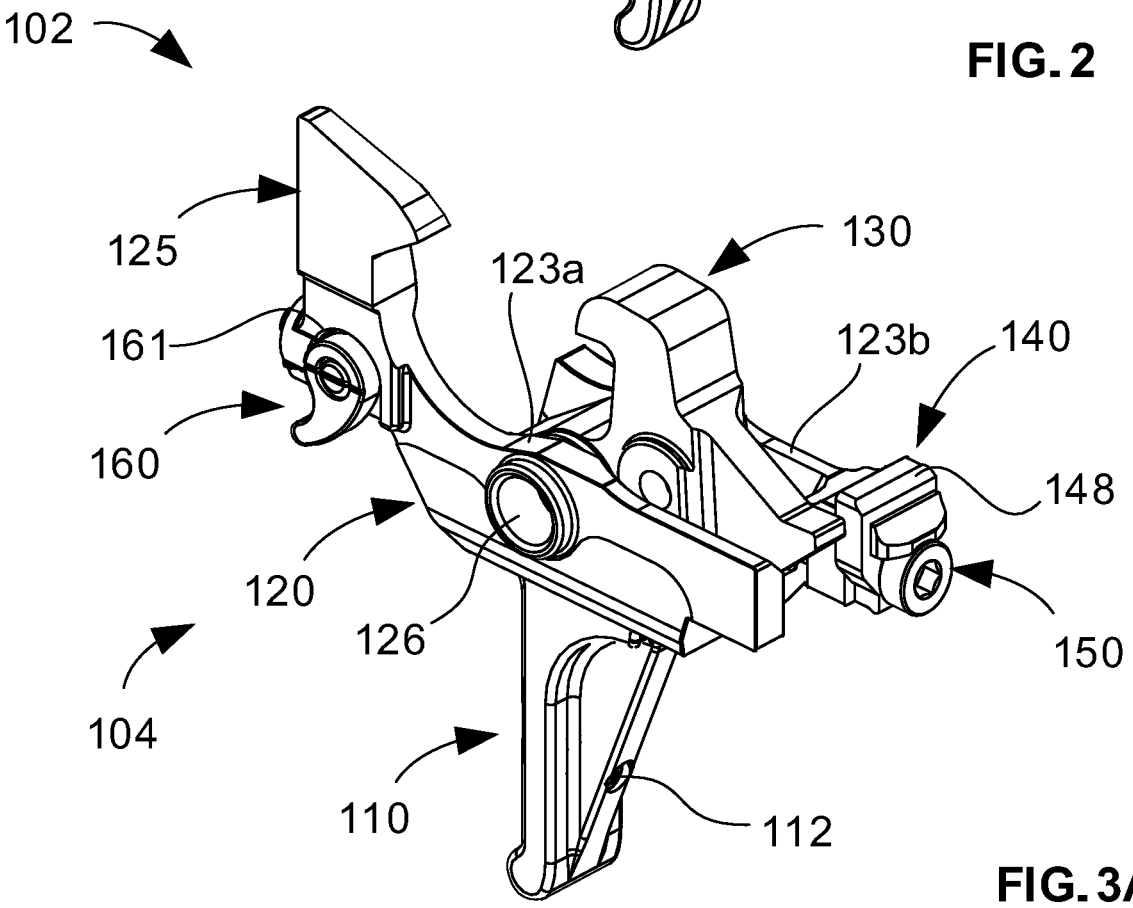
FIG. 3A is a perspective view of a trigger assembly of the fire control group of FIG. 2.
Figure 3B:
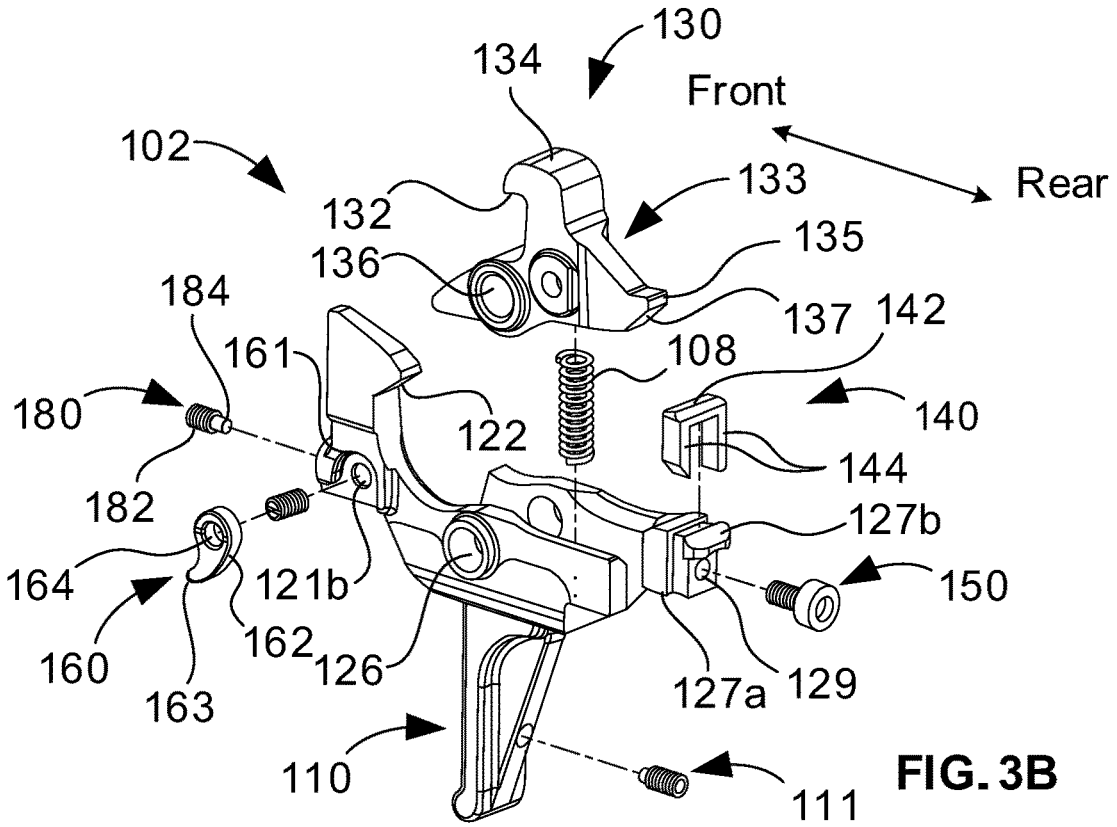
FIG. 3B is a first exploded view of the trigger assembly of FIG. 3A taken.
Figure 3C:
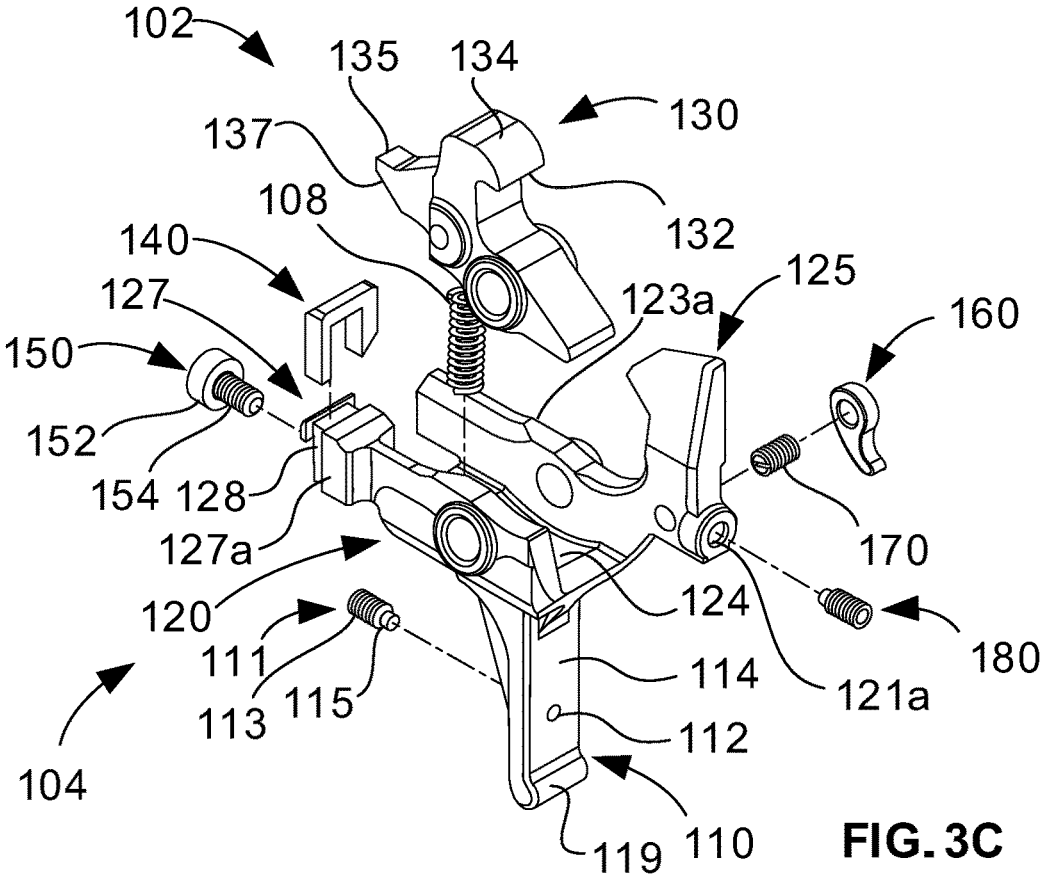
FIG. 3C is a second exploded view of the trigger assembly of FIG. 3A.

Trigger base or body 120 includes left and right sidewalls 123*a-b* that extend from a floor 124 so as to form a recess therebetween configured to receive disconnector 130 and disconnector spring 108. Sidewalls 123*a-b* each have a length that extends between a front end and a rear end thereof. A transverse bore 126 extends through sidewalls 123*a-b* in a right-left direction perpendicular to their length such that bore 126 intersects the recess. A sear hook or trigger sear 125 extends upwardly from the front end of left sidewall 123*a*. Trigger sear 125 has a sear surface 122 which is configured to engage/disengage a hammer sear 230 (see FIG. 4A), as described in more detail below. A first threaded opening 121*a* extends into left sidewall 123*a* at a fixed end of trigger sear 125 in a front to rear direction, and a second threaded opening 121*b* extends into left sidewall 123*a* at the fixed end of trigger sear 125 in a right to left direction or horizontal direction, as shown in FIGS. 3B and 3C. First and second threaded openings 121*a-a* intersect such that they are in communication with each other. Trigger base 120 also includes a safety engagement block or projection 127 that extends in a rearward direction from right sidewall 123*b*. Safety engagement block 127 has a saddle or U-shaped groove 128 formed between front and rear portions 127*a-b* thereof. A threaded opening 129 extends into block 127 in a rear to front direction, as best shown in FIG. 3B.

Figure 3D:
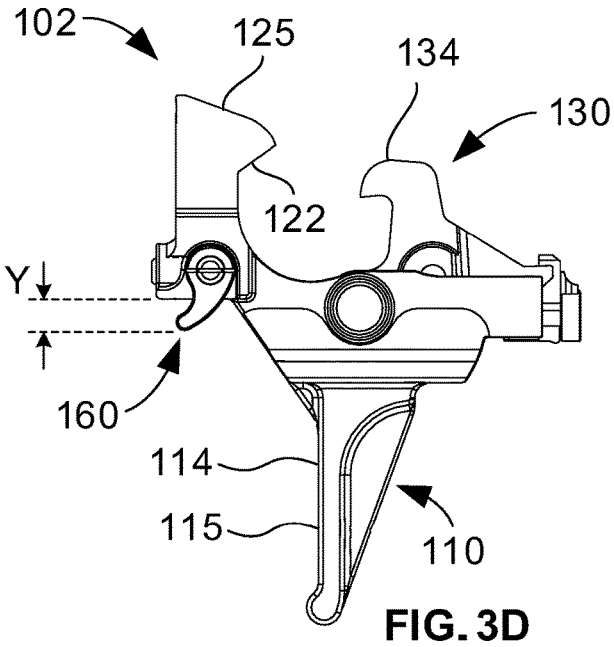
FIG. 3D is a side elevational view of the trigger assembly of FIG. 3A.
Figure 3E:
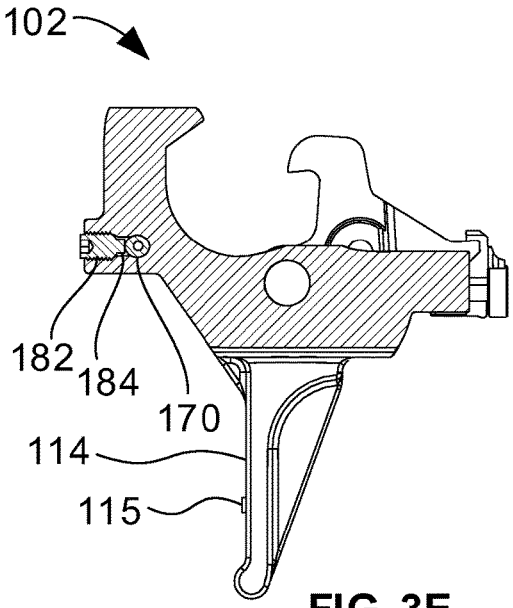
FIG. 3E is a first side cutaway view of the trigger assembly of FIG. 3A.

Over-travel member 160 is in the form of a cam lobe that has a cam surface or contact surface 162 extending to an apex 163. In this regard, cam surface 162 is eccentric with respect to a pivot axis of cam lobe 160 which is defined by a threaded opening 164 thereof. Cam lobe 160 is rotatably connected to left sidewall 123*a* via a threaded fastener or pivot screw 170 which extends through threaded opening 164 of cam lobe 160 and into second threaded opening 121*b* of left sidewall 123*a*. Pivot screw 170 is threaded along its length and can be used to rotate cam lobe 160 to a desired setting. Another threaded fastener or set screw 180 can be used to secure cam lobe 160 in its desired orientation. As shown in FIG. 3D, rotation of cam lobe 160 can position cam surface 162 at various heights or distances Y relative to a lower surface of base 120 adjacent cam lobe 160 which determines the amount of over-travel of trigger 104. In other words, the distance Y in a vertical direction between the cam surface 162 and trigger base 120 changes upon rotation of cam lobe 160. The distance Y determines the limit of angular movement of trigger assembly 102 which is reached when cam lobe contact surface 162 makes contact with the internal surface of receiver floor 11, as best shown in FIG. 8D. Set screw 180 has a threaded shaft 182 and an engagement nub 184 extending from threaded shaft 182. Set screw 180 is inserted into first threaded opening 121*a* so that engagement nub 184 engages pivot screw 170 to prevent its rotation and thereby secure cam lobe 160 in its desired orientation, as best shown in FIG. 3E. Engagement nub 184 may be made from a softer material than pivot screw 170 to help prevent marring or damage to pivot screw 170. For example, engagement nub 184 may be made from nylon or brass while pivot screw 170 may be made from steel, titanium, and the like. In this embodiment, the pivot screw 170 and cam lobe 160 are permanently staked together during manufacturing (not by the end user) to ensure that cam lobe 160 becomes captured and is not inadvertently removed from trigger 104 since integral retaining walls 161 of trigger 104 (see FIGS. 3A and 3D) limit the rotational range of cam lobe 160 once staking occurs. However, in other embodiments, pivot screw 170 and cam lobe 160 can be coupled using a thread locker compound or other mechanical methods, which may be applied by the end user.

Figure 3F:
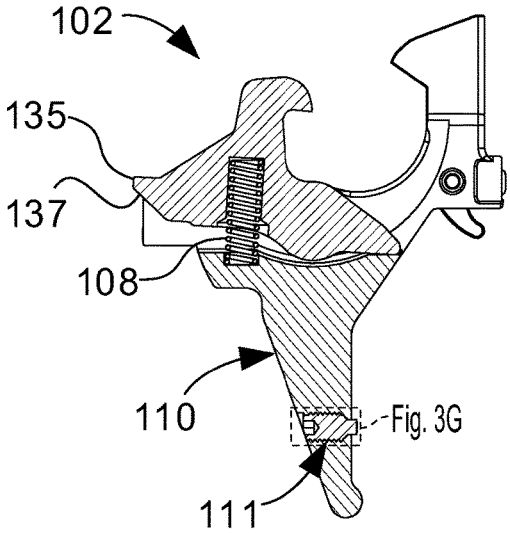
FIG. 3F is a second side cross-sectional view of the trigger assembly of FIG. 3A.
Figure 3H:
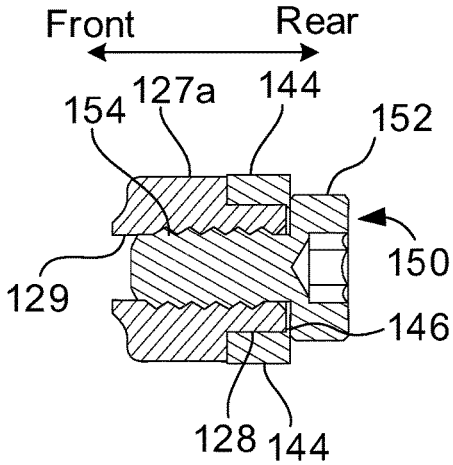
FIG. 3H is an enhanced cross-sectional top view of a safety engagement mechanism of the trigger assembly of FIG. 3A.

Safety engagement member or shim 140 has a cross-bar 142 and legs 144 extending downwardly from cross-bar 142 to form a generally horseshoe or U-shape. Such legs 144 and cross-bar 142 are straight but can be curved. Cross-bar 142 includes a chamfer or ramp face 148 at a rear edge thereof, as shown in FIG. 3A, which facilitates easy and consistent engagement by a safety selector arm 17 of firearm 10. As shown in FIG. 3H, each leg 144 has a flange 146 that extends radially inwardly from a rear side thereof. Safety engagement member 140 is positioned on saddle 128 so that legs 144 extend downwardly and cross-bar 142 is positioned at an upper side of safety engagement block 127. Safety engagement member 140 is moveable in an up-down direction so that cross-bar 142 can be positioned at various heights relative to safety engagement block 127 in a vertical direction. A threaded fastener or headed screw 150 secures safety engagement member 140 at a desired height. As shown in FIG. 3H, a threaded shaft 154 of screw 150 engages threaded opening 129 in safety engagement block 127, and a head 152 of screw 150 engages flanges 146 of safety engagement member 140 to secure safety engagement member 140 from further movement and at the desired height. Various embodiments of screw 150 may include one or more lock washer or serrated inner faces of head 152 to ensure adequate friction to prevent slippage of safety engagement member 140 as vertical pressure is applied by safety selector arm 30.

Figure 3G:
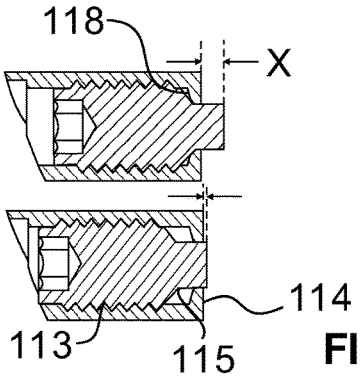
FIG. 3G is an enhanced cross-sectional view of an indexing member in a first and a second position within a trigger extension of the trigger assembly of FIG. 3A.

Trigger extension 110 extends downwardly from floor 124 of trigger base 120 at a location between the front and rear ends of sidewalls 123*a-b*. Trigger extension 110 has a front surface 114 which is flat along the majority of its length. However, a lower extent of trigger extension 110 may have a forward projecting lip 119, as shown. A threaded opening extends 112 through trigger extension 110 in a front-rear direction and is generally positioned at a side-to-side center of front surface 114. Threaded opening 112 has a reduced diameter at a front end of trigger extension 110 so as to form a shoulder 118, as shown in FIG. 3G.

An indexing screw 111 has a threaded shaft 113 and a nub 115 extending from threaded shaft 113. Nub 115 has a smaller diameter than threaded shaft 113. Indexing screw 111 is receivable within threaded opening 112 of trigger extension 110 so that nub 115 can be projected frontwards from threaded opening 112, as best shown in FIGS. 3F and 3G. The length of threaded shaft 113 is smaller than a length of threaded opening 112 so that indexing screw 111 can be adjusted within threaded opening 112 without threaded shaft 113 projecting from the rear of trigger extension 110. This allows the amount of length X of nub 115 extending from the front of trigger extension 110 to be adjusted for the desired feel, as shown in FIG. 3G. The shoulder 118 of threaded opening 112 acts as a stop indicating a maximum length X of nub 115 extends from opening 112. Nub 115 can be used by a user to quickly identify where their finger is on trigger extension 110 so that they can quickly and repeatedly position their finger at the desired location for a trigger pull. This is particularly useful for a flat trigger extension, such as the one depicted, as the positioning of the finger higher or lower on trigger extension 110 can affect how much force is consistently needed to reach trigger break in the cycle of operations.

Disconnector 130 generally includes a disconnector body 133 and a sear hook or disconnector sear 134 extending from disconnector body 133. A transverse bore 136 extends in a left-right direction through disconnector body 133. Disconnector sear 134 has a sear surface 132 for engagement with a corresponding sear surface/face 232 on hammer sear 230, as described in more detail below. Disconnector 130 is positioned within the disconnector recess of trigger base 120 so that disconnector sear 134 (forward-facing) of disconnector 130 faces trigger sear 125 (rear facing), as best shown in FIG. 3D. Disconnector spring 108 is positioned between disconnector body 133 and floor 124 of trigger base 120 at a rearward position offset from a center of bore 136 which provides a frontward rotational bias to disconnector 130, as best shown in FIGS. 3C and 3F. Disconnector 130 includes a chamfered projection 135 extending rearward that includes an angled cut or chamfer 137 at the lower end that provides clearance for the head of a rivet head 15, as shown in FIG. 8D.

Figure 4A:
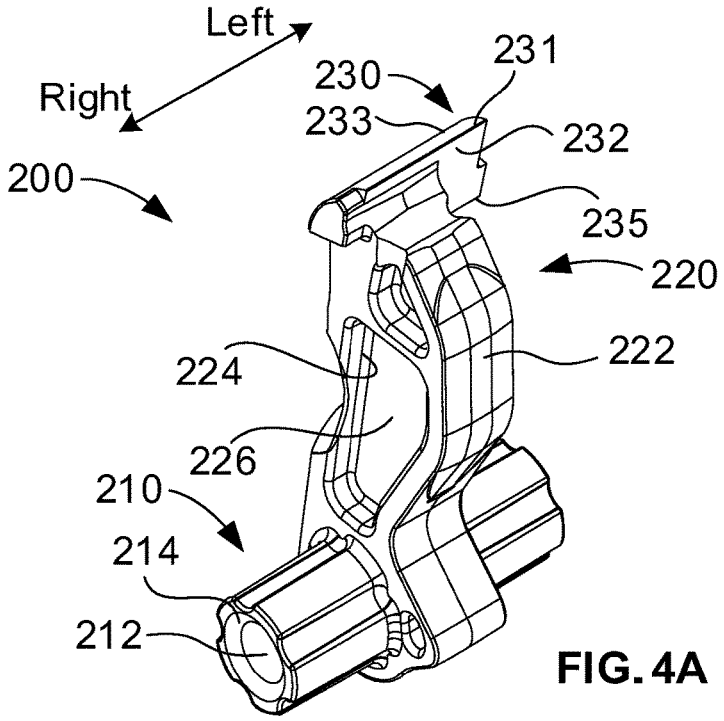
FIG. 4A is a perspective view of a hammer of the fire control group of FIG. 2.
Figure 4B:
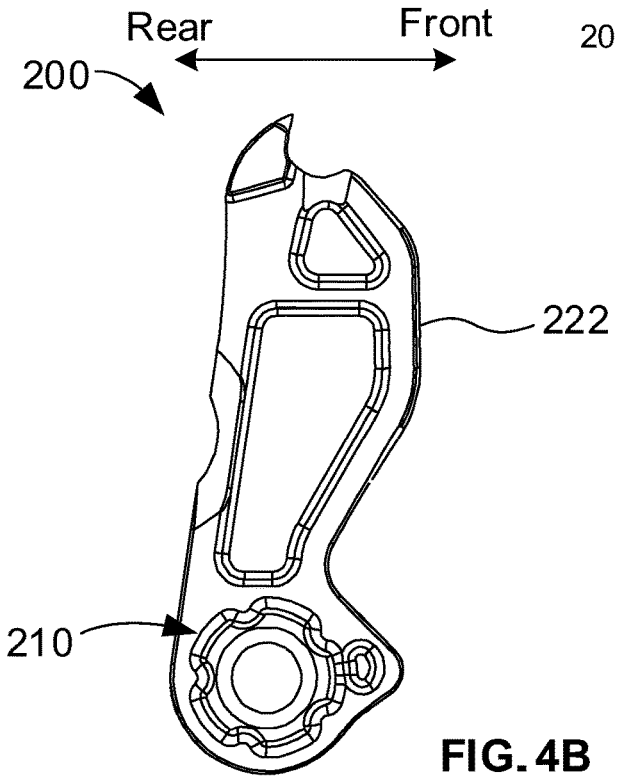
FIG. 4B is a first-side elevational view of the hammer of FIG. 4A.
Figure 4C:
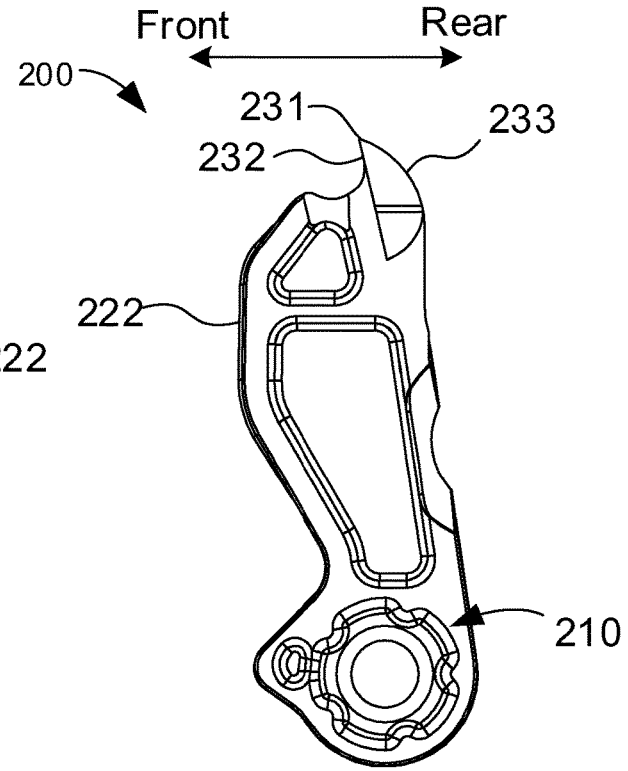
FIG. 4C is a second-side elevational view of the hammer of FIG. 4A.

Hammer 200, as shown in FIGS. 4A-4C, generally includes a hammer spring spool or hammer spring retention boss 210, hammer body 220, and hammer sear 230. A smooth bore 212 extends in a left-right direction through hammer spring spool 210 and defines a pivot axis about which hammer 200 rotates. Conically tapered surfaces 214 of spring spool 210 define left and right apertures of bore 212, as shown in FIGS. 4A. Hammer body 220 extends from spool 210 and includes a front face or strike face 222 that is curved in a single plane that extends transverse to a length of hammer body 220. Hammer body 220 also includes ribs 224 which define a perimeter to one or more cutouts 226 that extend into body 220 at both left and right sides thereof. Such cutouts 226 reduce the mass of hammer 200 and shift its center of mass closer to the pivot axis as compared to hammer 4. Such mass reduction configuration and short moment arm (i.e., length between the pivot axis and center of mass) allows hammer 200 to rotate more quickly to impact a firing pin and generates greater striking energy as compared to hammer 4. This can be advantageous when using ammunition with primers that may be difficult to ignite, such as steel primers commonly found in military style ammunition. Additionally, the reduced mass of hammer 200 reduces its inertia which may reduce bolt tail damage and speeds up the cycling of hammer 200 for better on-target precision. Hammer sear 230 extends from an end of body 220 remote from spring spool 210 and includes a sear surface 232 at a front side thereof. Hammer sear surface 232 terminates at a hammer upper sear edge 231 where hammer sear surface 232 intersects an upper arc face 233. Also, on a left side of hammer 200, hammer sear surface 232 terminates at a lower sear edge 235 where hammer sear surface 232 intersects arc face 233. Arc face 233 is a curvature that acts as a cam when it engages disconnector 130, as described further below.

FIGS. 5A-5F depict a pivot pin assembly 300 according to an embodiment of the present disclosure which may be used in lieu of pivot pins 107. Pivot pin assembly 300 is generally used to couple the components of fire control group 100 together and secure them to receiver 12 of firearm 10. Pivot pin assembly 300 includes first and second screws 330*a-b* and an expanding mandrel pivot pin 302. Pivot pin 302 may be made from a metal material, such as stainless steel and the like, and may have a friction reducing coating. For example, pivot pin 302 may be coated with Nickle Boron or Polytetrafluoroethylene (PTFE).

Pivot pin 302 includes a head 310 and a shaft 320 extending from head 310. Head 310 includes a plurality of fingers or expansion members 312, a cylindrical expansion shoulder or boss 314, and a threaded opening 311. Threaded opening 311 of head 310 is a blind opening that extends into the head along a longitudinal axis of pivot pin 302. Each expansion member 312 has a free end which includes a flange 313 extending radially outwardly and a tapered inner surface 315. Expansion members 312 are each separated from an adjacent member 312 by a slot 317 and are arranged about threaded opening 311 such that tapered surfaces 315 of the expansion members 312 together define a conically tapered aperture of threaded opening 311. Expansion members 312 are each fixed at one end such that they are cantilevered and independently moveable in a radial direction. This embodiment depicts four slots 317 that extend into expansion members 312, but that may vary in quantity and depth along the longitudinal axis of pin 302, thereby providing more or less expansion force. In the embodiment shown, boss 314 is separated in a longitudinal direction from expansion members 312 by a groove 316 and extends circumferentially about the longitudinal axis of pin 302. In the embodiment depicted, slots 317 stop short of groove 316, but in other embodiments slots 317 may intersect groove 316. Boss 314 includes a conically tapered surface 318 transitioning to shaft 320 at a side thereof opposite that of groove 316.

Shaft 320 of pivot pin 302 is cylindrical and includes a plurality of fingers or expansion members 322 and a threaded opening 321. Threaded opening 321 of shaft 320 is a blind opening that extends into shaft 320 along a longitudinal axis of pivot pin 302. Expansion members 322 are located at an end of shaft 320 opposite that of head 310 and are arranged about threaded opening 321 of shaft 320. Expansion members 322 are each separated from an adjacent member 322 by a slot 327 and are fixed at one end such that they are cantilevered 320 and independently moveable in a radial direction. This embodiment shows four slots 327 into expansion members 322, but may vary in quantity and depth along axis of pin 302, providing more or less expansion force. Each expansion member 322 has a free end which includes a tapered inner surface 325. Tapered surface 325 of the expansion members 322 together define a conically tapered aperture of the threaded opening of shaft 320.

Figure 5A:
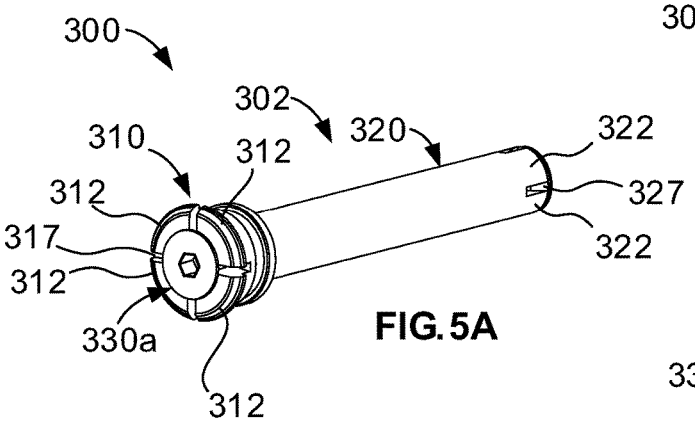
FIG. 5A is a first side perspective view of a pivot pin assembly according to an embodiment of the present disclosure.
Figure 5B:
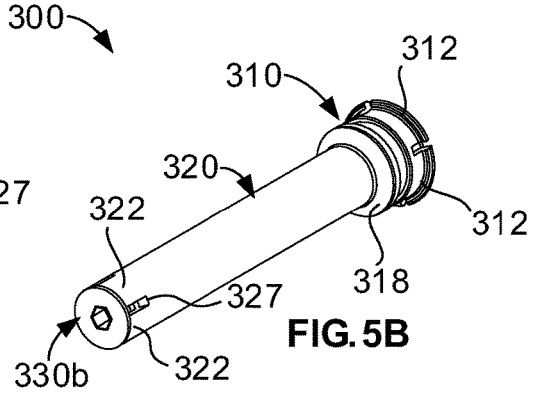
FIG. 5B is a second side perspective view of the pivot pin assembly of FIG. 5A.
Figure 5C:
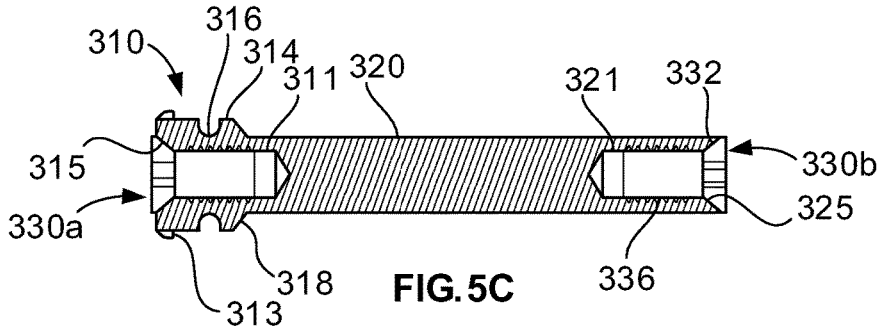
FIG. 5C is a cross-sectional view of the pivot pin assembly of FIG. 5A taken along a midline thereof.
Figure 5D:
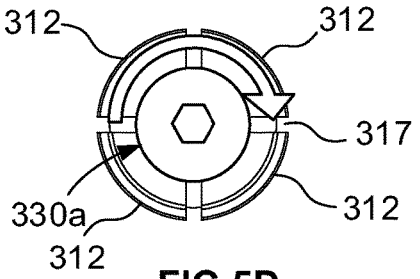
FIG. 5D is a first side view of the pivot pin assembly of FIG. 5A.
Figure 5E:
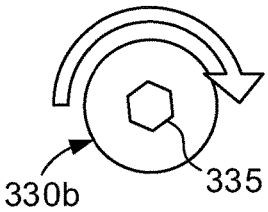
FIG. 5E is a second side view of the pivot pin assembly of FIG. 5A.
Figure 5F:
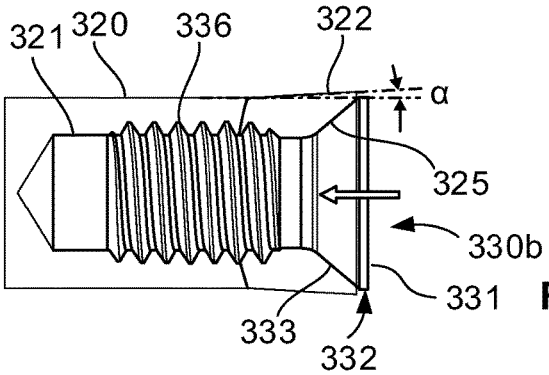
FIG. 5F is an enhanced cross-sectional view of the pivot pin assembly of FIG. 5A.

First and second screws 330*a-b* each include a tapered head 332 and a threaded shaft 336. Tapered head 332 has a flat surface 331 with a tool engagement opening 335 extending therein and a conically tapered surface 333 opposite flat surface 331. First screw 330*a* is received in threaded opening 311 of head 310, and second screw 330*b* is received in threaded opening 321 of shaft 320. As shown in FIG. 5D, rotating first screw 330*a* clockwise drives screw 330*a* into threaded opening 311 which causes tapered surface 333 of screw 330*a* to engage the corresponding tapered surfaces 315 of expansion members 312 thereby moving expansion members 312 radially outwardly. Similarly, as shown in FIGS. 5E and 5F, rotating second screw 330*b* clockwise drives screw 330*b* into the threaded opening of shaft 320 which causes tapered surface 333 of screw 330*b* to engage corresponding tapered surfaces 325 of expansion members 322 thereby moving expansion members 322 radially outwardly. In this regard, members 322 flair outwardly so that the end of shaft 320 forms a variable angle $\alpha$ which is a measure of the angular deviation of expansion members 322 from an initial, unexpanded position in which members 322 are at zero degrees and together form a cylinder.

Figure 6:
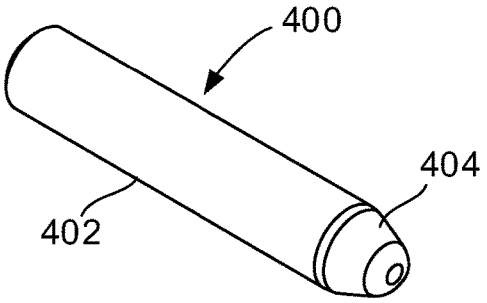
FIG. 6 is an alignment pin according to an embodiment of the present disclosure.

FIG. 6 depicts a temporary alignment pin or installation pin 400. Alignment pin 400 may hold components of trigger assembly 102 and fire control group 100 together during assembly with receiver 12 of firearm 10 and is configured to ease insertion into such components for alignment of the same. In this regard, the length of alignment pin 400 is generally shorter than that of pivot pin 302 so that alignment pin 400, along with fire control group components, can together be dropped into a firearm receiver 12. Alignment pin 400 includes a cylindrical shaft 402 and a conically tapered end 404. Alignment pin 400 may have a friction reducing coating. For example, alignment pin 400 may be coated with Nickle Boron or with PTFE. Also, alignment pin 400 may be made with a vibrant color, such as red, for example. Since the alignment pin 400 is intended to provide temporary connection to the various components of fire control group 100, the vibrant color helps indicate to the user its temporary nature for safety purposes and to provide visual reference for installing pivot pin 302.

Figure 7A:
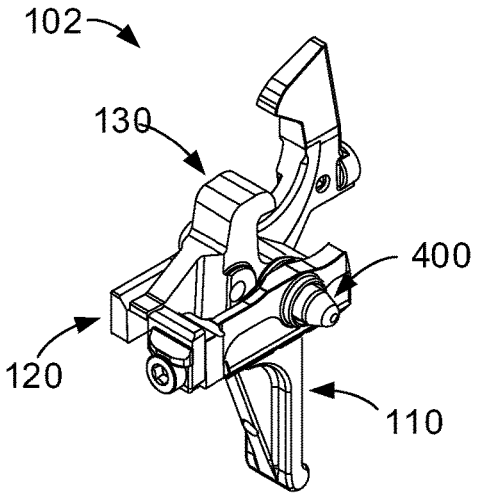
FIGS. 7A-7C depict a method of assembling the fire control group of FIG. 2 to the firearm of FIG. 1A.
Figure 7B:
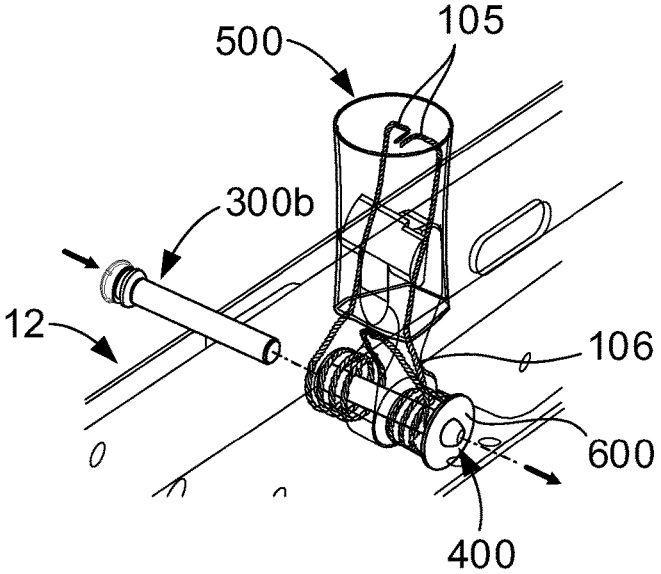
Figure 7C:
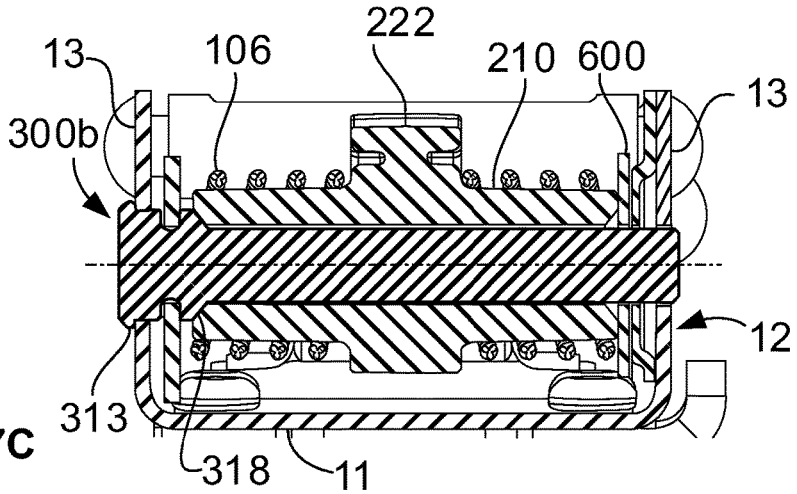

FIGS. 7A-7C depict a method of coupling fire control group 100 to firearm 10. In this regard, two pivot pins assemblies 300*a-a* may be used to separately couple trigger assembly 102 and hammer 200 to a firearm receiver 12. In the method, disconnector 130 and disconnector spring 108 are placed within recess of trigger base 120 so that bores 126 and 136 of trigger 104 and disconnector 130 respectively align. Alignment pin 400 is inserted into bores 126 and 136 to couple trigger base 120 and disconnector 130 together. It should be mentioned that even if bores 126 and 136 are not perfectly aligned, tapered tip 404 allows alignment pin 400 to nonetheless be inserted through the bores 126, 136 after which the bores 126, 136 will be aligned. The assembled trigger assembly 102 is then inserted into receiver 12 so that alignment pin 400 is aligned with corresponding openings in receiver 12. A first pivot pin 300*a* is then inserted through receiver 12 and into the bores 126, 136 of trigger base 120 and disconnector 130 while concurrently pushing out alignment pin 400. In this regard, first pivot pin assembly 300*a* takes the place of alignment pin 400. Once pivot pin 302 is full seated with flanges 313 of expansion members 312 abutting an outer surface of receiver 12, the first and second screws 330*a-b* of pivot pin 302 are rotated clockwise which causes fingers 312, 322 to expand and push against receiver 12 so as to firmly secure pivot pin 302 to receiver 12. Such expansion creates a frictional connection that reduces or prevents wobble/slop in fire control group 100 relative to receiver 12, helping to ensure consistent "break" of trigger assembly 102 and cycling of hammer 200.

The same alignment pin 400 or another alignment pin 400 is then inserted into bore 212 of hammer spool 210 and also into an opening of an optional thrust washer 600, as best shown in FIG. 7B. Thrust washer 600 in this regard is positioned on a right side of spool 210. Hammer spring 106 is wound around spool 210 so that free tails 105 of spring 106 extend upwardly from spool 210 toward hammer sear 230. An installation sleeve 500 is positioned about free tails 105 for hammer spring arrest (i.e., to prevent spring from coming unwound). Sleeve 500 is transparent which permits users to verify alignment of spring tails 105 and retention on spool 210 and hammer sear face 232 of hammer 200. However, in some embodiments, sleeve 500 may be opaque. Installation sleeve 500 is preferably flexible and may be ribbed so that it can expand and contract like an accordion which allows it stretch/deform as it is slid over hammer 200 and spring 106. This assembly is then placed into receiver 12 so that alignment pin 400 aligns with openings of receiver 12. A second pivot pin assembly 300*b* is then inserted through receiver 12 to displace alignment pin 400 and take its place.

FIG. 7C is a cross-sectional view of hammer 200 as coupled to receiver 12. As shown, tapered surface 318 of boss 314 engages the conically tapered surface 214 of spool 210 which creates a tight fit to prevent excessive movement between hammer 200 and pin assembly 300*b* while allowing for rotation of hammer 200 relative to pin assembly 300*b*. At an opposite side of spool 210, thrust washer 600 is positioned between receiver sidewall 13 and spool 210 to constrain lateral movement of hammer 200 to further limit excessive movement. Limiting excessive movement in this regard helps ensure consistent and uniform contact on firing pin 30 and consistent reset and break of trigger assembly 102 relative to hammer 200. Thrust washer 600 may be plastic or polymer, such as PTFE, which helps reduce friction of hammer 200 against receiver walls 13. First and second screws 330*a-b* of pivot pin 302 are operated to expand the expansion members 312, 322 of pivot pin 302 and frictionally secure pivot pin assembly 300*b* to receiver 12. Installation sleeve 500 may then be removed. Free tails 105 of spring 106 are then coupled to trigger assembly 102. Once fire control group 100 is securely coupled to receiver 12, adjustments can be made to obtain the desired over-travel and safety engagement, as describe further below.

FIGS. 8A-8L depict a method of operations using fire control group 100. As shown in FIG. 8A, firearm 10 is in safe mode such that a safety selector arm 17 is in a safe position with arm 17 extending down within receiver 12 and contacting or positioned slightly above cross-bar 142 of safety engagement member 140. This creates mechanical interference that blocks rearward movement (i.e., counter-clockwise angular movement) of trigger assembly 102 which in turn prevents the hammer sear face 232 from slipping off or breaking away from trigger sear face 122 of trigger 104. In other words, the mechanical interference blocks the firearm from discharging. Safety engagement member 140 can be adjusted upwards or downwards as necessary to provide optimal functioning of the safety mechanism. The adjustability of safety engagement member 140 vertically, up or down, allows trigger assembly 102 to be adapted to a multitude of Kalashnikov firearms despite geometric and dimensional differences among them.

Figure 8B:
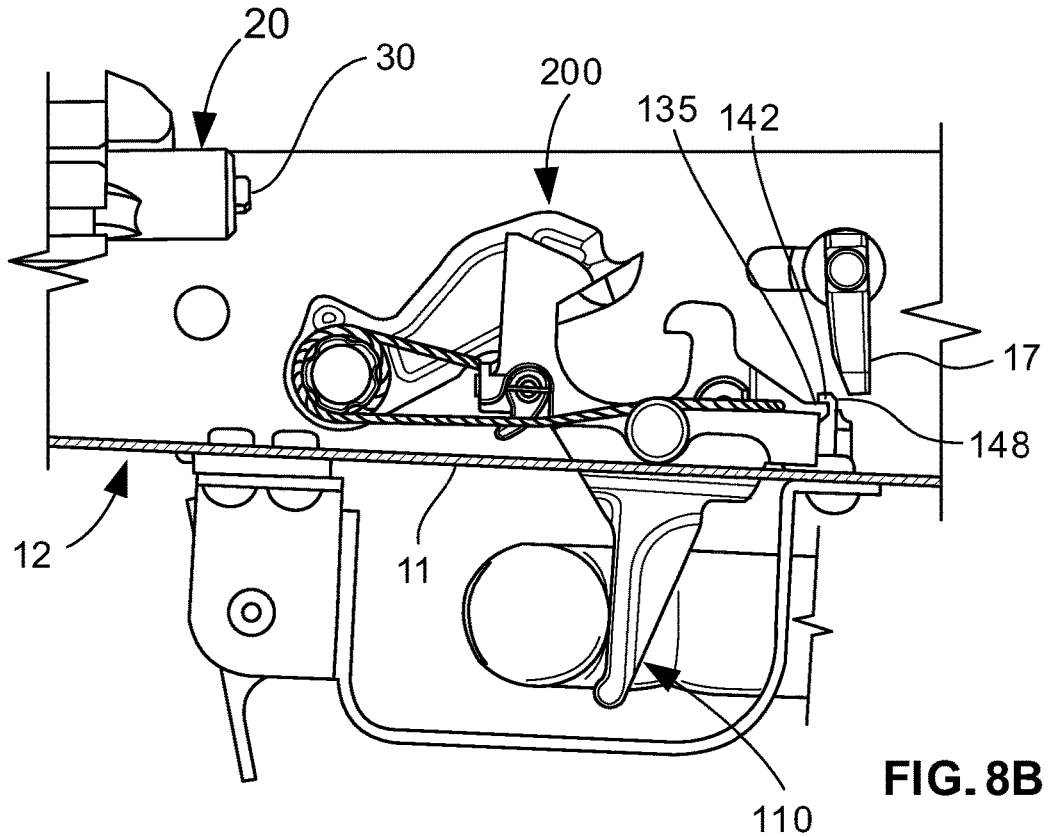

As shown in FIG. 8B, safety selector arm 17 is rotated counter-clockwise, away from safety engagement member 140 so that fire control group 100 is now operable to fire in semi-automatic or fully-automatic mode (not shown). Semi-automatic mode is illustrated. In semi-automatic mode, the first stage to the cycle of operations is pre-travel in which trigger extension 110 is pulled causing trigger assembly 102 to rotate counterclockwise in the view of FIG. 8B about first pivot pin 300*a*. This, in turn, causes trigger sear 125 of trigger 104 to slide along hammer sear 230 of hammer 200 (see FIGS. 8B and 8C) until break at which point trigger sear 125 and hammer sear 230 are no longer in contact (see FIG. 8D). Indexing screw 111 allows the user to find their desired finger position on front face 114 of trigger extension 110 just by feel alone.

Figure 8C:
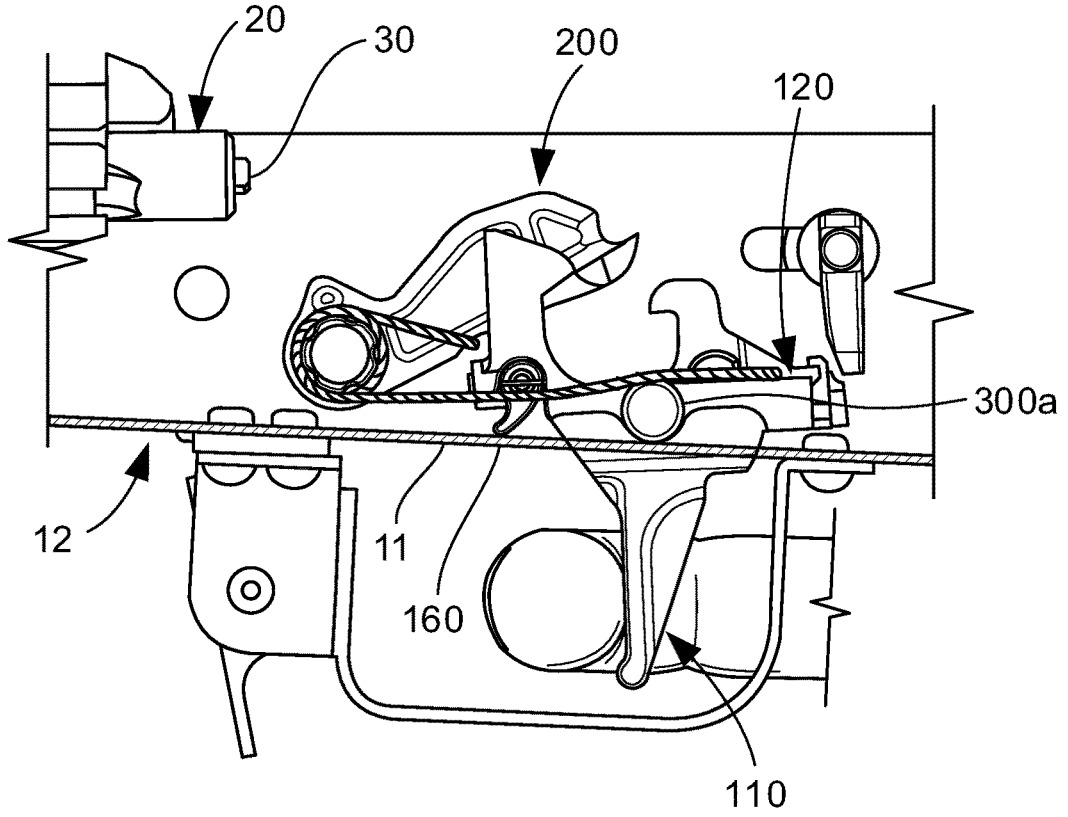

Upon break, hammer 200 is freed so that hammer spring 106 rotates hammer 200 (counter-clockwise as viewed in FIGS. 8C and 8D) about second pivot pin 300*b* thereby propelling hammer 200 toward firing pin 30. As shown in FIG. 8F, due to the curvature of strike face, a gap G is created between hammer strike face 222 and a tail 21 of bolt 20. In this regard, energy transfer from hammer 200 to firing pin 30 is more efficient than that of hammer 4, which has a near planar strike face, as contact clears tail 21 of bolt 20 and is instead focused on firing pin 30. In addition, wear of bolt 20 is minimized. This efficiency is also maintained when using a shortened firing pin, such as pin 30' shown in FIG. 8G, in the event such short firing pin 30' is inadvertently or otherwise utilized. Firing pin 30' has a peen deformed tail 32 which results in a shorter length than pin 30, and is typically a result of inadequate material properties, such as hardness, or extended use. As can be seen, the gap G' created between bolt tail 21 and hammer strike face 222 is smaller than that shown in FIG. 8F. However, a gap nonetheless is present when using shortened firing pin 30' such that the benefits of curved strike face 222 of hammer 200 can be realized for a variety of firearms.

Figure 8D:
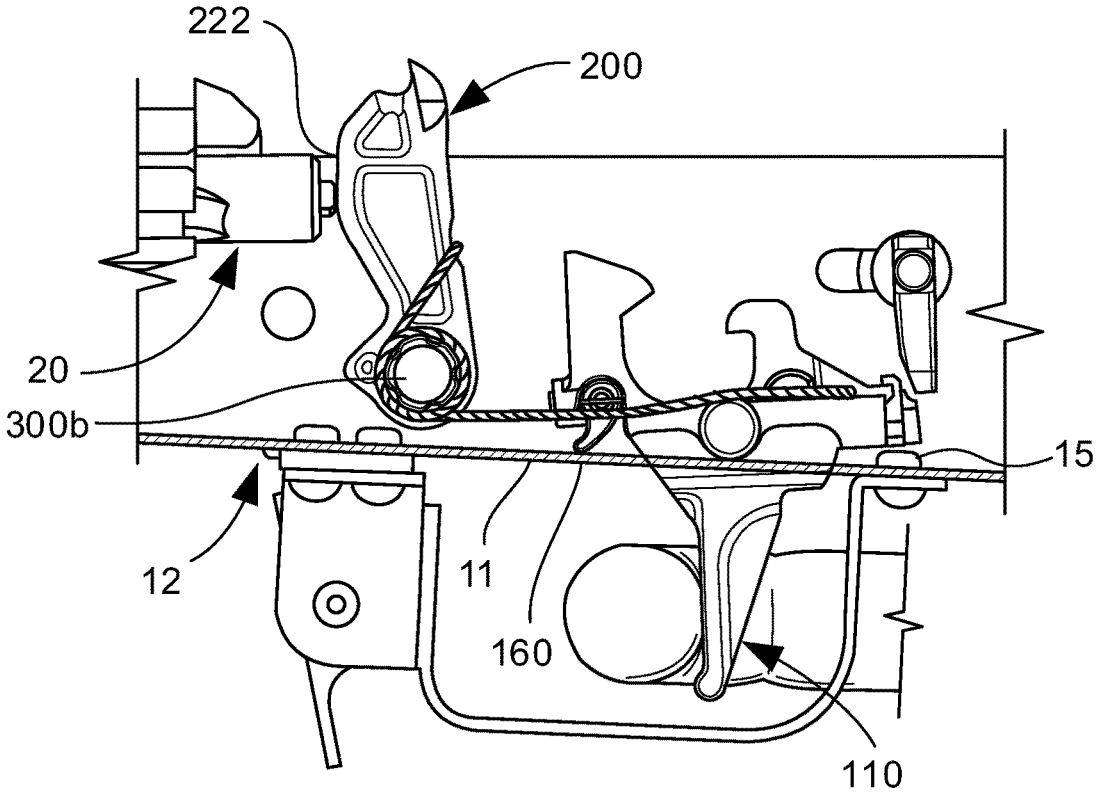
Figure 8E:
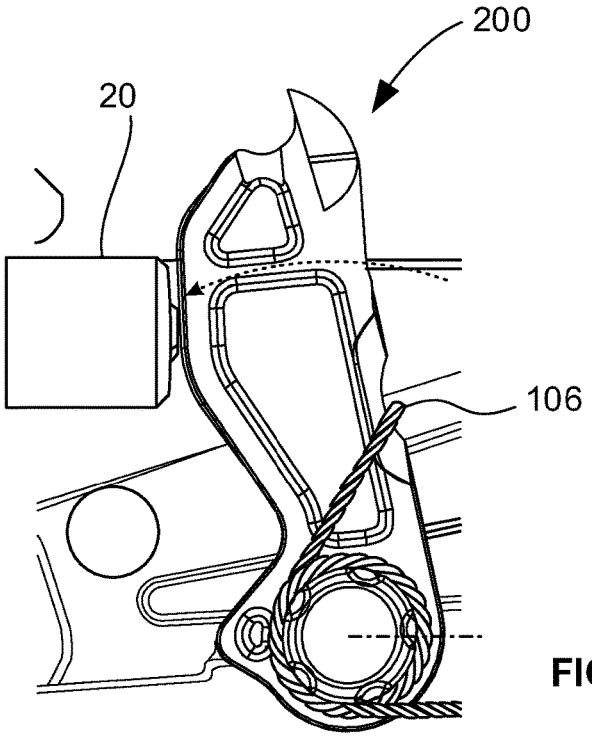
Figure 8F:
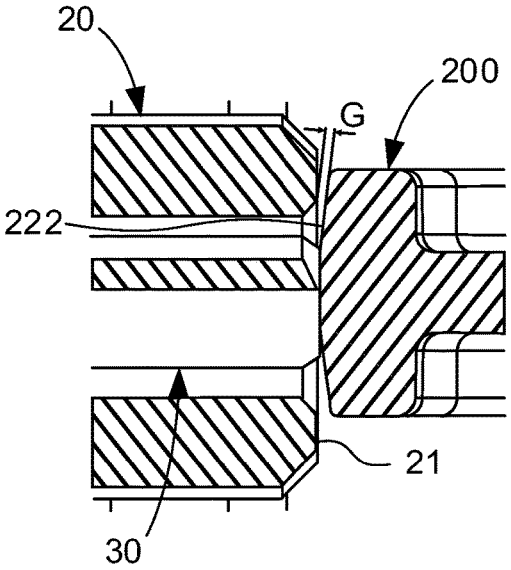
Figure 8G:
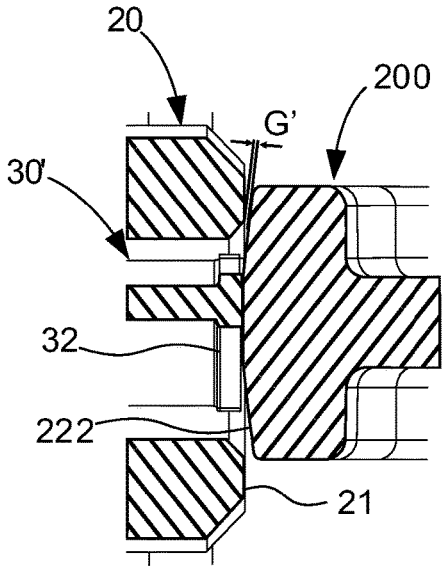

At the same time hammer 200 is freed, trigger assembly 102 continues its positive angular movement (i.e., over-travel in the counter-clockwise direction from view of FIG. 8D). Cam lobe 160 limits the amount of positive angular movement of trigger assembly 102 after break. In this regard, as shown in FIGS. 8B-8D, as trigger assembly 102 is rotated about first pivot pin 300*a*, cam lobe 160 moves toward receiver floor 11 until it contacts receiver floor 11 thereby limiting further positive angular movement of trigger assembly 102. Cam lobe 160 can be adjusted so that the distance Y between the lowest point of cam lobe 160 and trigger base 120 is shorter or longer depending on the amount of over-travel desired.

Figure 8H:
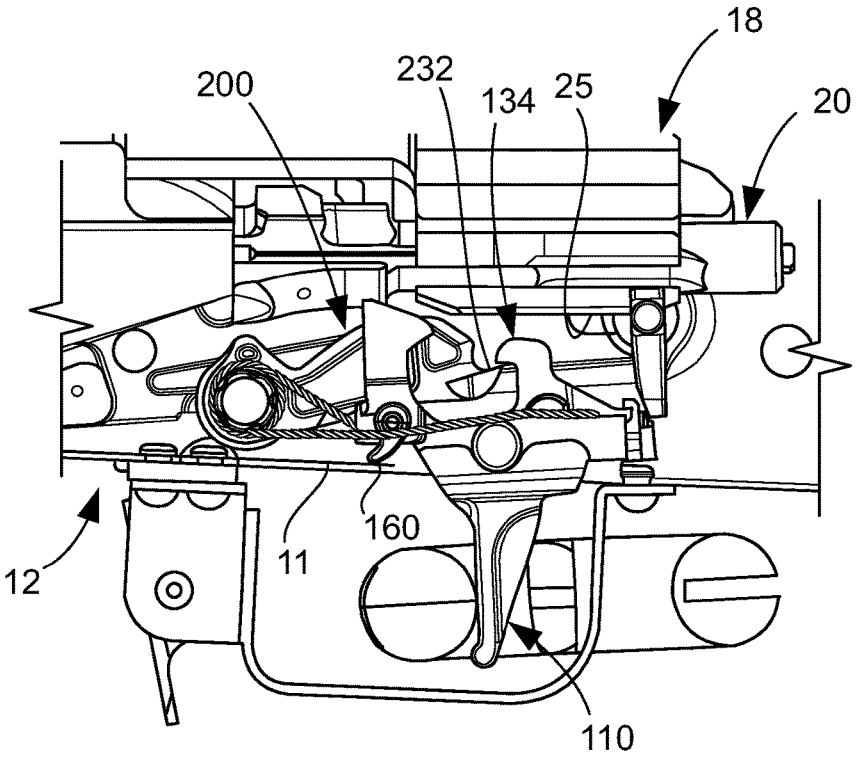
Figure 8I:
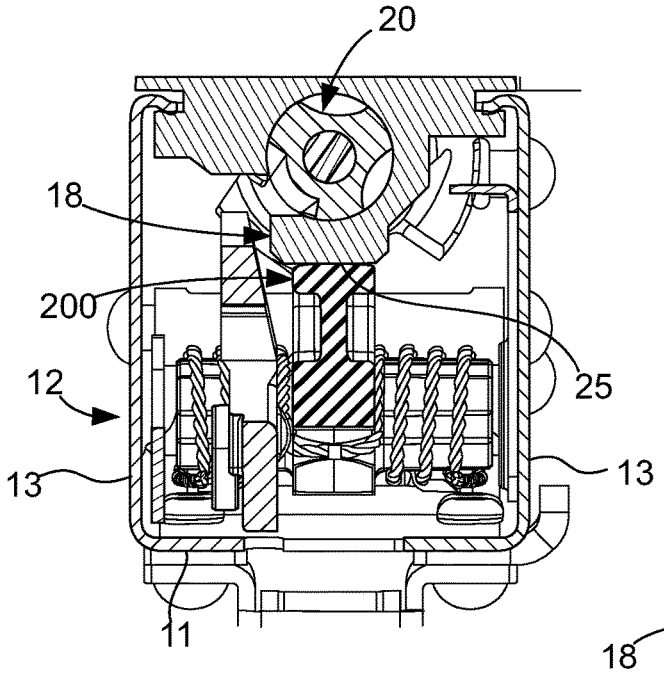

Once the round is fired, fire control group 100 is reset. In this regard, gas energy from the round being fired causes bolt carrier 18 and bolt 20 to be moved in concert to the rear, as shown in FIG. 8H. As this occurs, bolt carrier 18 rotates hammer 200 toward disconnector 130 such that the sear surfaces 132, 232 of disconnector 130 and hammer 200, respectively, engage thereby catching hammer 200 in the downward direction. In this regard, arc face 233 acts as a cam by driving disconnector 130 rotationally rearward as it engages disconnector sear 134, as best shown in FIG. 8H.

Figure 8J:
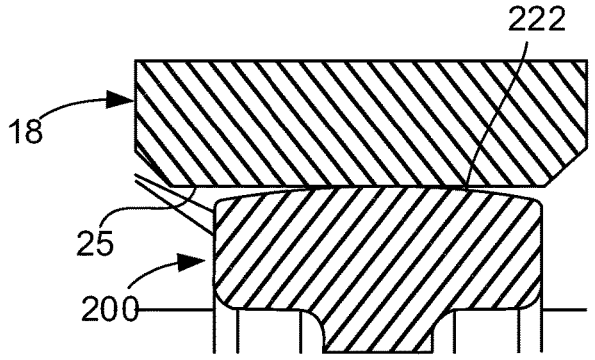
Figure 8K:
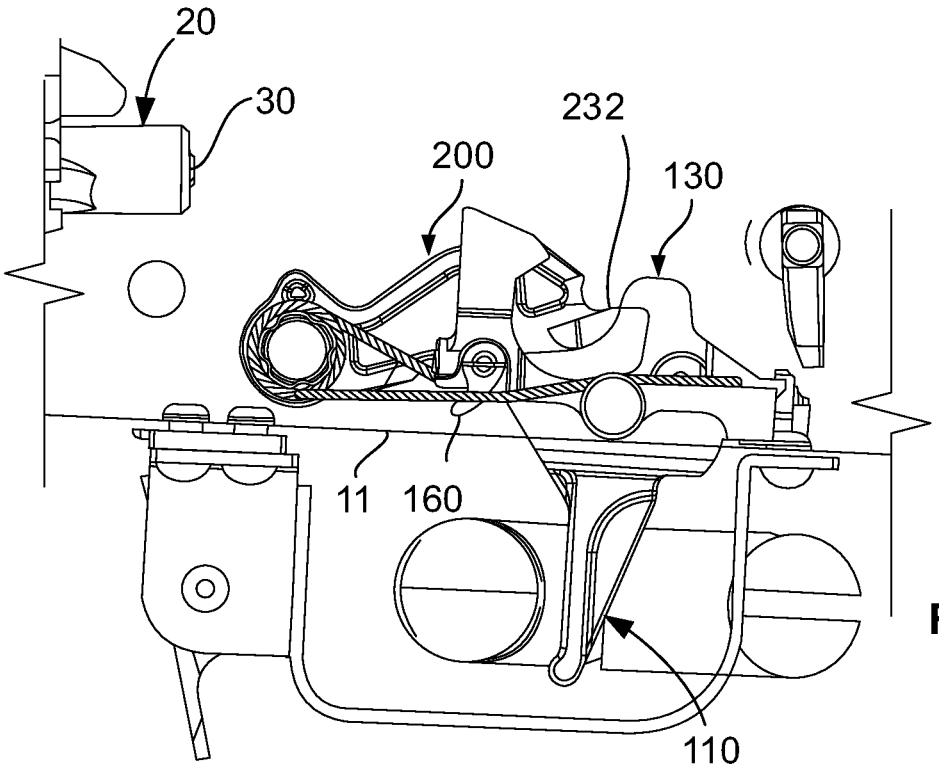
Figure 8L:
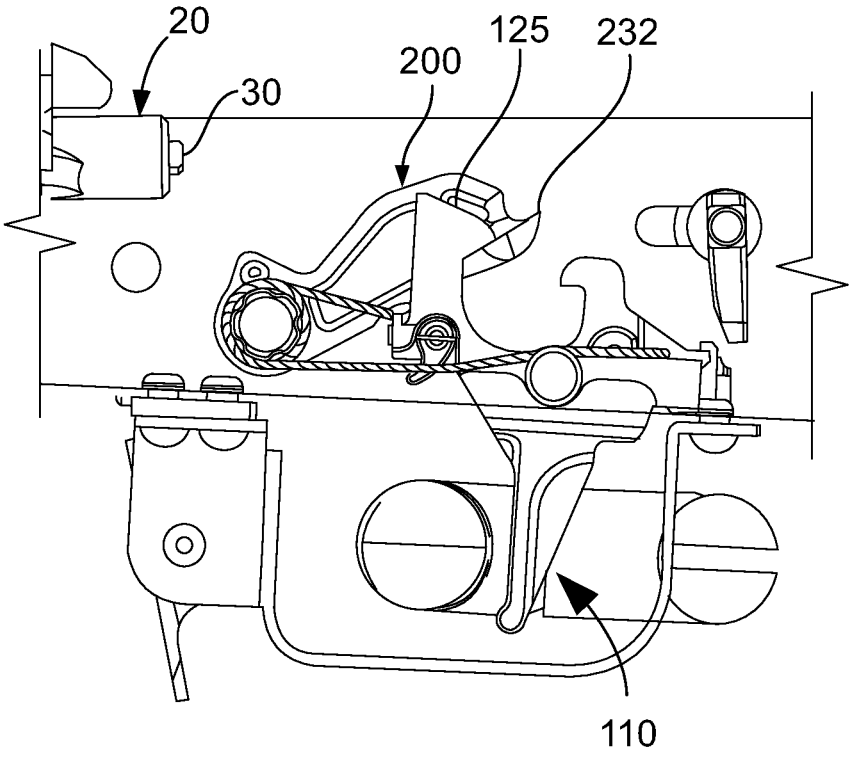

As shown in FIGS. 81 and 8J, a bottom surface 25 of bolt carrier slides along strike face 222 of hammer 200 as bolt carrier 18 moves to the rear. Due to the curvature of hammer strike face 222, there is less surface to surface contact and less friction between hammer 200 and bolt carrier 18 than what would occur with hammer 4 which result in smoother operation. It is noted that in fully-automatic mode, disconnector 130 is held back by safety selector 17 to preclude disconnector from catching hammer 200, and hammer 200 is held back and then activated by an auto-sear (not shown). Hammer 200 is typically momentarily delayed by a rate reducer (not shown) to further prevent "hammer follow," carrier tail damage, out-of-battery ignition, and to better control the rate of fire. Thus, it should be understood that fire control group 100 is operable in fully-automatic mode as well. As shown in FIG. 8K, trigger extension 110 is released or disengaged, in this embodiment, causing trigger assembly 102 to rotate (clockwise in the perspective of FIG. 8K) about first pivot pin 300*a* back to its initial position. As this occurs, sear surfaces 132, 232 of disconnector 130 and hammer 200, respectively, slide away from each other until hammer 200 is released from disconnector 130. When it is released, hammer sear 230 catches on trigger sear 125 of trigger 104, as shown in FIG. 8L. In this regard, hammer lower sear edge 235 is the release boundary for trigger sear 122. Fire control group 100 is now reset for a follow-up shot.

Figure 9A:
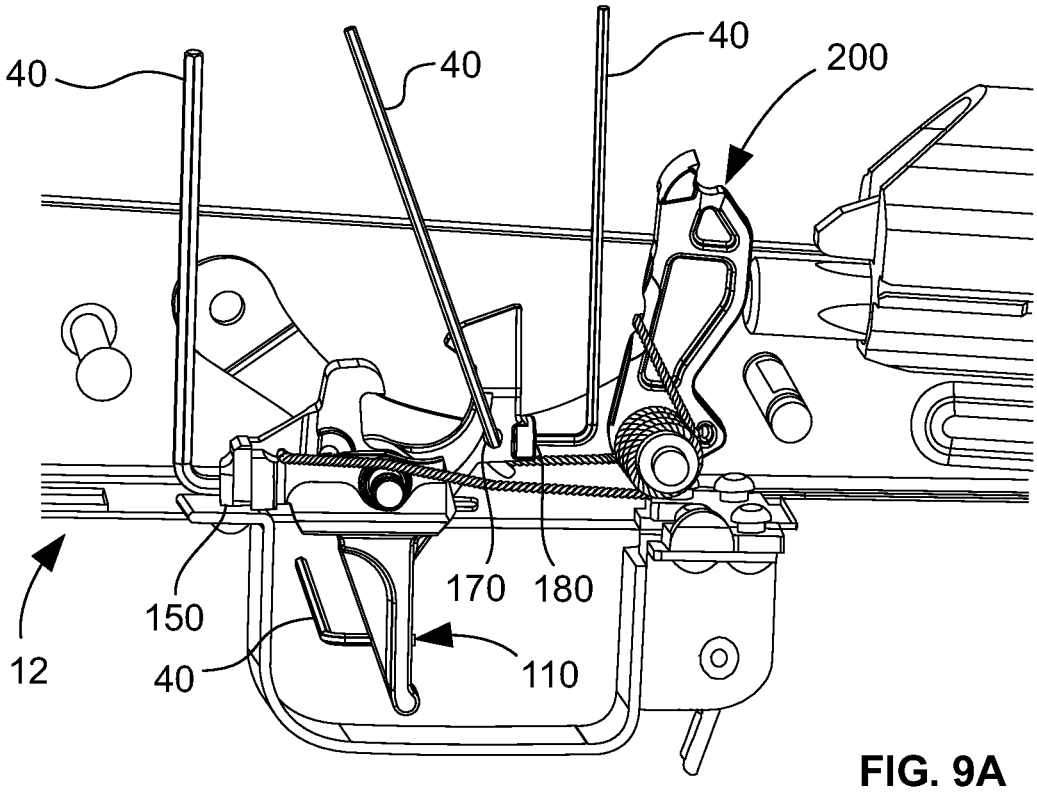
FIGS. 9A-9B depict a method of adjusting the fire control group of FIG. 2 in the firearm of FIG. 1A.
Figure 9B:
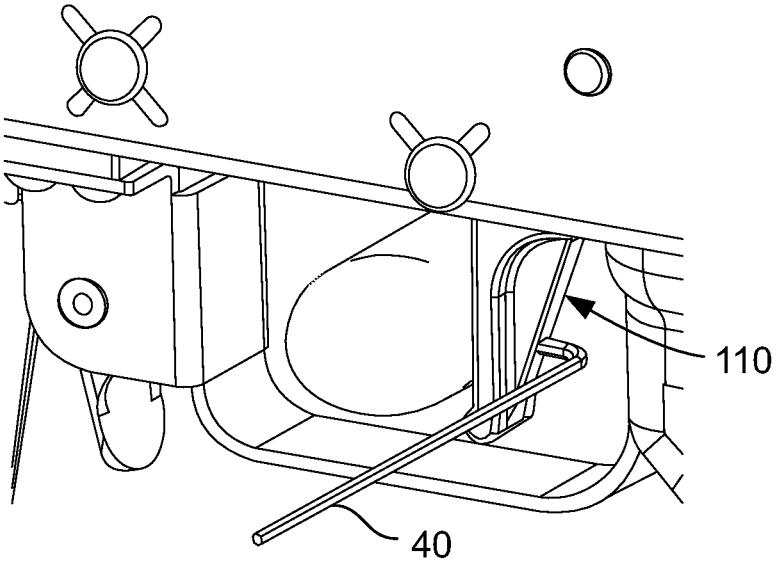

FIGS. 9A and 9B illustrate the ease of adjustment of fire control group 100 when assembled in firearm 10. As shown, fire control group 100 does not need to be removed from firearm 10 for over-travel member 160, safety engagement member 140, or indexing member 111 to be adjusted. For example, as shown in FIG. 9A, with hammer 200 in the fire position, an Allen wrench 40 can easily access screws 150, 170 and 180 in order to adjust over-travel member 160 and safety engagement member 140 within receiver 12. In this regard, an Allen wrench 40 can reach down into receiver 12 and loosen headed screw 150 so that safety engagement member 140 can be moved up or down as desired and then tightened to secure safety engagement member 140 in the desired position. Also, an Allen wrench 40 can loosen locking set screw 180, and Allen wrench 40 can engage pivot screw 170 to rotate cam lobe 160 to an orientation in which distance Y is increased or decreased, as desired. In this regard, increasing the distance Y shortens over-travel while decreasing Y lengthens over-travel. Once over-travel member 160 is in the desired position, locking set screw 180 can be tightened back down to secure over-travel member 160. Similarly, as shown in FIG. 9B, an Allen wrench 40 can engage indexing screw 111 from the rear of trigger extension 110 to adjust the amount of nub 115 extending from trigger extension 110. Again, this can all be done without disassembly so that the user can quickly and easily try different configurations until the desired configuration is achieved.

FIGS. 10-13B depict alternative trigger extension embodiments 1010*a*-*d* that may be included in trigger 104. Each of these trigger extensions 1010*a*-*d* have different indexing elements so that the user can select their desired feel.

Figure 10:
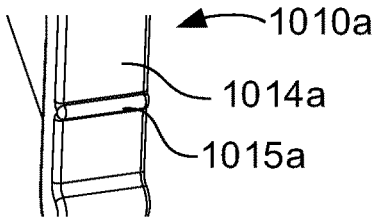
FIG. 10 is an enhanced perspective view of a trigger extension according to an alternative embodiment of the present disclosure.

In this regard, FIG. 10 depicts an indexing element 1015*a* according to another embodiment that is in the form of a horizontal ridge. Such horizontal ridge 1015*a* is an elongate semi-cylinder which extends across the flat front face 1014*a* of trigger extension 1010*a* and projects outwardly therefrom.

Figure 11:
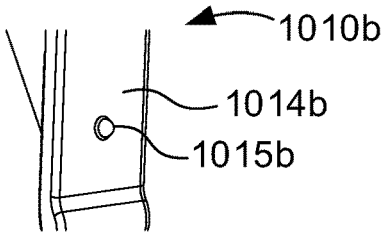
FIG. 11 is an enhanced perspective view of a trigger extension according to another embodiment of the present disclosure.

FIG. 11 depicts an indexing element 1015*b* according to a further embodiment that is in the form of a hemispherical nub extending from the flat front face 1014*b* of trigger extension 1010*b* and projecting outwardly therefrom. Nub 1015*b* differs from nub 15 in that it is integral with trigger extension 1010*b* rather than as a separate component. Thus, unlike nub 15, nub 1015*b* is not adjustable. Additionally, nub 1015*b* is generally dome-shaped or hemispherical. This may provide a softer, less aggressive feel than nub 15.

Figure 12A:
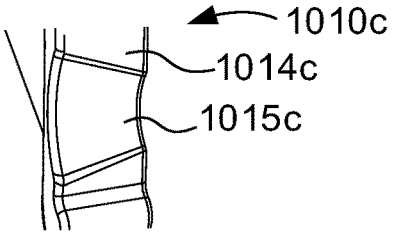
FIG. 12A is an enhanced perspective view of a trigger extension according to yet another embodiment of the present disclosure.
Figure 12B:
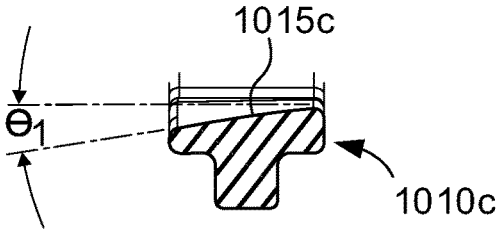
FIG. 12B is a cross-sectional view of the trigger extension of FIG. 12A.

FIGS. 12A and 12B depict an indexing element 1015*c* according to yet another embodiment that is in the form of concave indentation. This concave indentation 1015*c* tapers in two dimensions and is concavely curved. In a first dimension, as shown in FIG. 12A, the height of the indentation 1015*c* from top to bottom narrows (i.e., tapers) from right to left. In a second dimension, as shown in FIG. 12B, the depth of indentation 1015*c* tapers from deeper to shallower in a right to left direction to form an incline angle of θ1. This configuration is generally configured for right-handed shooters as indentation 1015*c* is configured to conform to a right-hand index finger. It should be noted that indexing screw 111 may also be used in conjunction with embodiments 1010*c* and 1010*d*.

Figure 13A:
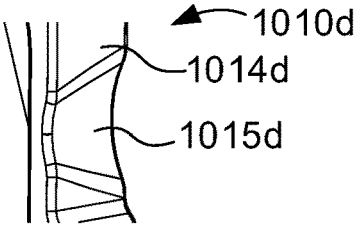
FIG. 13A is an enhanced perspective view of a trigger extension according to a further embodiment of the present disclosure.
Figure 13B:
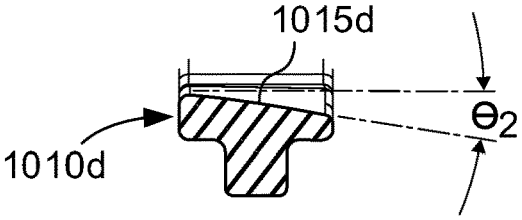
FIG. 13B is a cross-sectional view of the trigger extension of FIG. 13A.

FIGS. 13A and 13B depict an indexing element 1015*d* according to yet another embodiment that is in the form of concave indentation. This concave indentation 1015*d* tapers in two dimensions and is concavely curved. In a first dimension, as shown in FIG. 13A, the height of the indentation 1015*d* from top to bottom narrows (i.e., tapers) from left to right. In a second dimension, as shown in FIG. 13B, the depth of indentation 1015*d* tapers from deeper to shallower in a left to right direction or horizontal direction to form an incline angle of θ2. θ1 is the inverse of θ2. This configuration is generally configured for left-handed shooters as indentation 1015*d* is configured to conform to a left-hand index finger. It should be noted that indexing screw 111 may also be used in conjunction with embodiments 1010*c* and 1010*d*.

Figure 14:
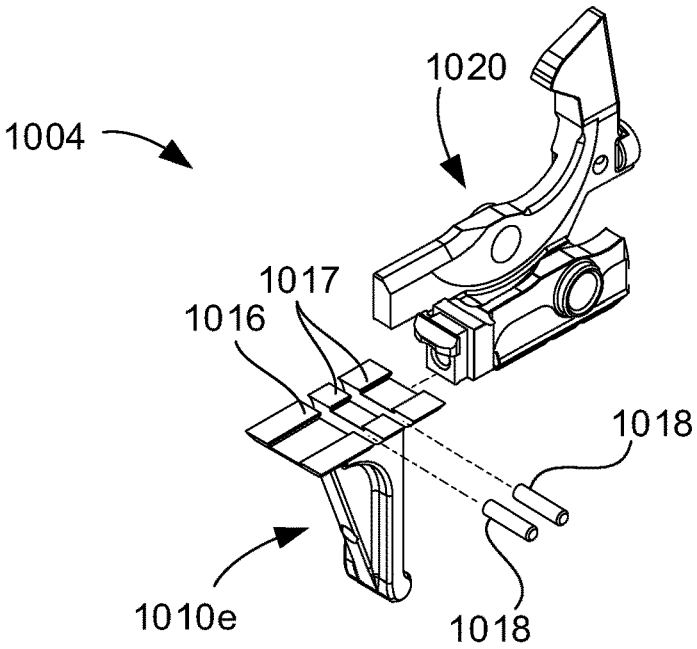
FIG. 14 is an exploded view of a trigger according to alternative embodiment of the present disclosure.

FIG. 14 depicts a trigger 1004 according to another embodiment of the present disclosure. Trigger 1004 is similar to trigger 104 in that it includes a trigger base 1020 and a trigger extension 1010*e*. However, unlike trigger 104, trigger 1004 is modular such that trigger extension 1010*e* and trigger base 1020 are separate components that are connected to each other via retaining pins 1018. In this regard, a top end of trigger extension 1010*e* includes a female dovetail groove 1016 extending in a front-rear direction. A plurality of retaining grooves 1017 extend crosswise in a left-right direction perpendicular to dovetail groove 1016 and intersect the same. As shown, two of such semi-circular retaining grooves 1017 are included in the embodiment depicted. However, more than two retaining grooves 1017 may be included.

Trigger base 1020 includes a male dovetail extension (not shown) which extends in a front-back direction and is configured to be slidably received in dovetail groove 1016 of trigger extension 1010*e*. Semi-circular retaining grooves (not shown) extend crosswise through the male dovetail extension of trigger base 1020 and are configured to align with retaining grooves 1017 of trigger extension 1010*e* so as to form individual circular channels for each retaining pin 1018. Thus, when extension 1010*e* and base 1020 are engaged, pins 1018 may be inserted into their respective channels in order to secure trigger extension 1010*e* to trigger base 1020. This allows trigger base 1020 or trigger extension 1010*e* to be swapped out for another.

Figure 15:
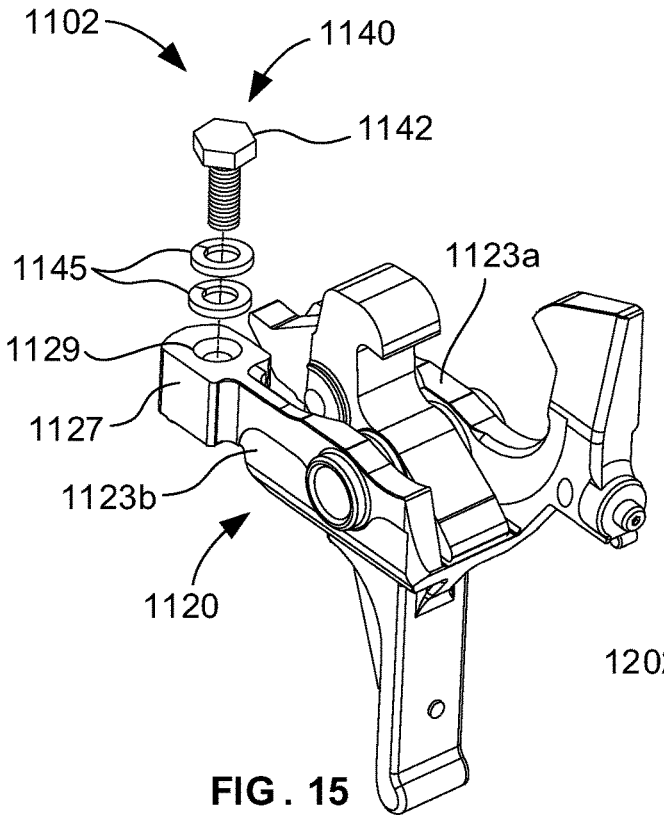
FIG. 15 is a perspective view of a trigger assembly according to an alternative embodiment of the present disclosure.

FIG. 15 depicts a trigger assembly 1102 according to another embodiment of the present disclosure. Trigger assembly 1102 is similar to trigger assembly 102 with the exception of the safety engagement member 1140 and trigger base 1120 which is adapted to accommodate such safety engagement member 1140. In this regard, trigger base 1120 includes a safety engagement block or projection 1127 extending in a rearward direction from a right sidewall of 1123*b* of base 1120 and includes a downwardly extending threaded opening 1129. Safety engagement member 1140 is a hex head screw which is configured to be received in such threaded opening 1129. One or more washers or shims 1145 may also be provided. Washers 1145 each act as spacers to adjust the height a head 1142 of screw 1140 a predetermined distance above block 1127. Washers 1145 may each have the same thickness or may have differing thicknesses. Thus, in operation, a safety selector arm, such as selector arm 30, engages head 1142 of screw 1140 to prevent operation of the fire control group in a similar fashion as that shown in FIG. 8A.

Figure 16:
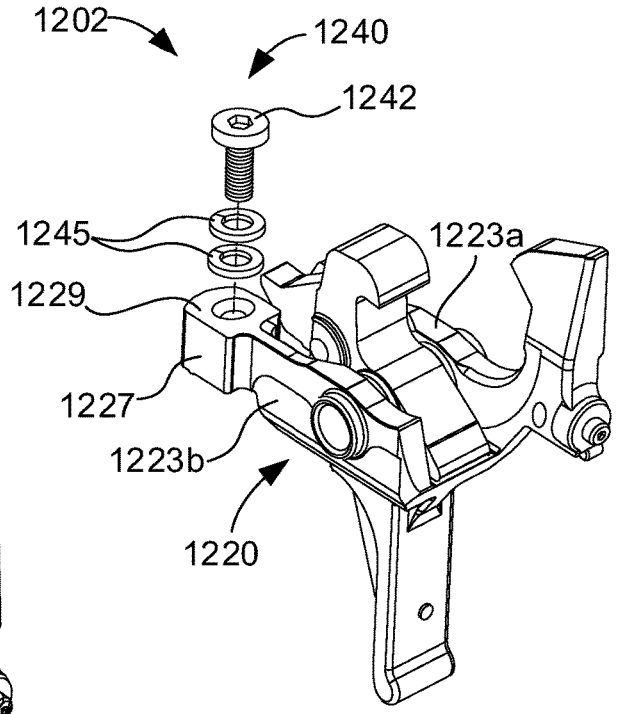
FIG. 16 is a perspective view of a trigger assembly according to another embodiment of the present disclosure.

FIG. 16 depicts a trigger assembly 1202 according to another embodiment of the present disclosure. Trigger assembly 1202 is similar to trigger assembly 102 with the exception of the safety engagement member 1240 and trigger base 1220 which is adapted to accommodate such safety engagement member 1240. In this regard, trigger base 1220 includes a safety engagement block or projection 1227 extending in a rearward direction from a right sidewall of 1223*b* of base 1220 and includes a downwardly extending threaded opening 1229. Safety engagement member 1240 is a hex socket screw which is configured to be received in such threaded opening 1229. One or more washers 1245 may also be provided. Washers 1245 each act as spacers to adjust the height a head 1242 of screw 1240 a predetermined distance above block 1227. Thus, in operation, a safety selector arm, such as selector arm 30, engages head 1242 of screw 1240 to prevent operation of the fire control group in a similar fashion as that shown in FIG. 8A.

Figure 17:
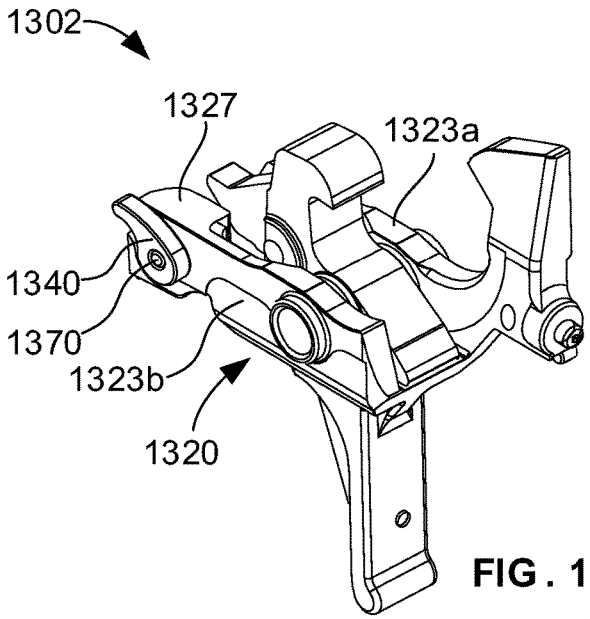
FIG. 17 is a perspective view of a trigger assembly according to a further embodiment of the present disclosure.
Figure 18A:
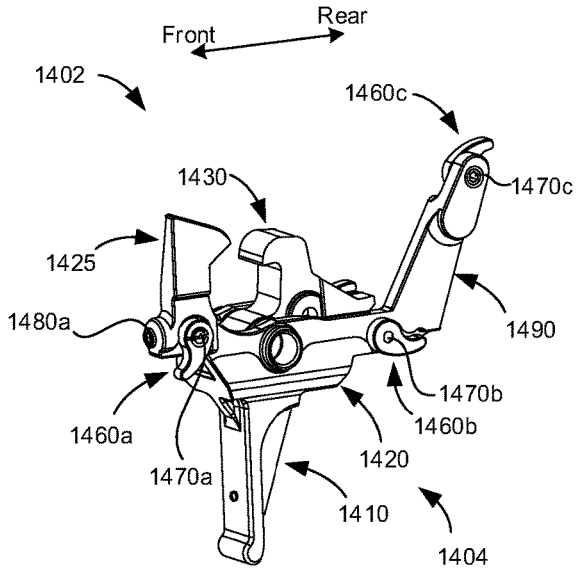
FIG. 18A is a first perspective view of a trigger assembly according to yet another embodiment of the present disclosure.
Figure 18B:
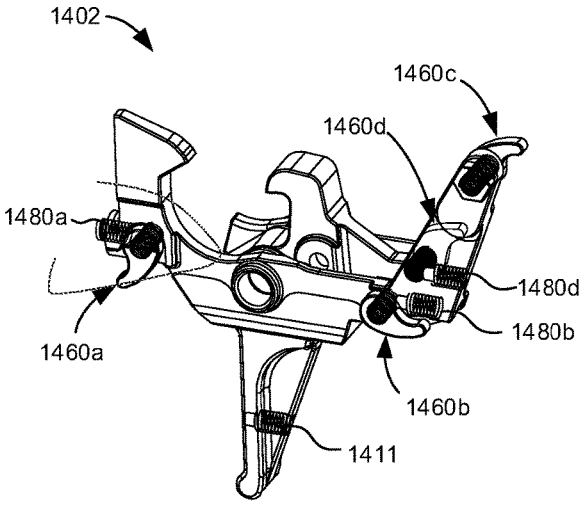
FIG. 18B is a first transparent perspective view of the trigger assembly of FIG. 18A.
Figure 18C:
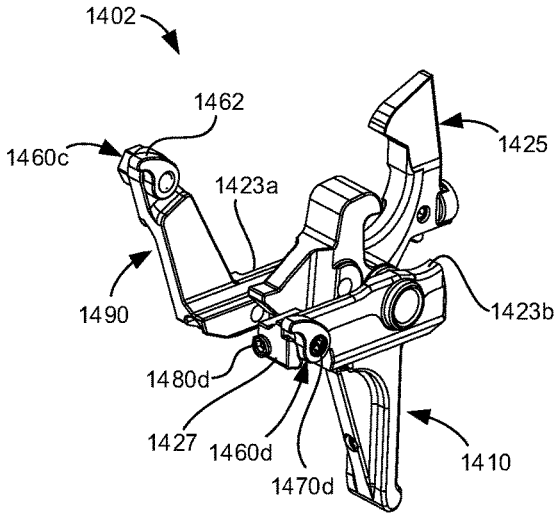
FIG. 18C is a second perspective view of the trigger assembly of FIG. 18A.
Figure 18D:
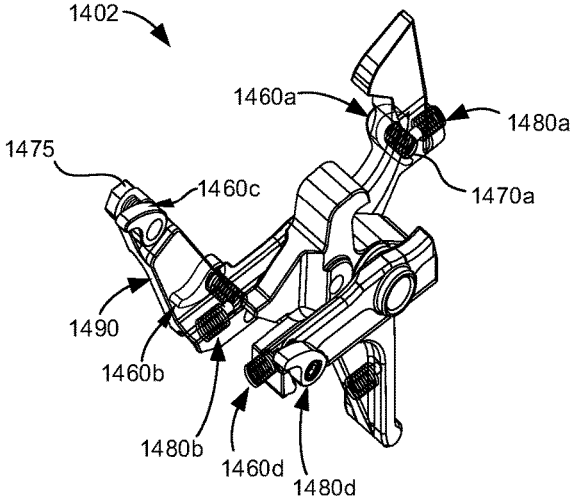
FIG. 18D is a second transparent perspective view of the trigger assembly of FIG. 18A.

FIG. 17 depicts a trigger assembly 1302 according to another embodiment of the present disclosure. Trigger assembly 1302 is similar to trigger assembly 102 with the exception of the safety engagement member 1340 and trigger base 1320 which is adapted to accommodate such safety engagement member 1340. In this regard, trigger base 1320 includes a safety engagement block or projection 1327 extending in a rearward direction from a right sidewall of 1323*b* of base 1320 and includes a two intersecting threaded openings (not shown). Safety engagement member 1340 is a cam lobe like that of cam lobe 160. In this regard, a pivot pin and set screw like that of pivot screw 170 and set screw 180 can be used to adjust and secure cam lobe 1340. In this regard, rotation of cam lob 1340 can adjust the height at which it projects above block 1327. Thus, in operation, a safety selector arm, such as selector arm 30, engages cam lobe 1340 to prevent operation of the fire control group in a similar fashion as that shown in FIG. 8A. Safety engagement member 1340 may be staked together with pivot screw 1370 during manufacturing to ensure they remain coupled, similar to the staking of cam lobe 160 and pivot screw 170 described above.

FIGS. 18A-18D depict a trigger assembly 1402 according to an even further embodiment of the present disclosure. Trigger assembly 1402 is similar to trigger assembly 102 in that it includes a disconnector 1430 and trigger 1404 with a trigger extension 1410 and trigger base 1420. In addition, trigger base 1420 includes a sear hook or trigger sear 1425, over-travel member 1460*a* which is in the form of a cam lobe, and safety engagement member 1460*d*. In the embodiment depicted, safety engagement member 1460*d* is a cam lobe similar to cam lobe 1340 of trigger assembly 1302 in FIG. 17. Although, it should be understood that safety engagement member 1460*d* can be in the form of any of the previous embodiments mentioned above.

However, trigger assembly 1402 differs in that it also includes a pre-travel member 1460*b* and a forced-reset member 1460*c* while trigger base 1420 is configured for the same. In this regard, left sidewall 1423*a* of trigger base 1420 includes a third threaded opening that extends in a rear to front direction at a rear end of left sidewall 1423*a*, and a fourth threaded opening that extends in a horizontal direction such that these openings are in communication with each other. Cam lobe 1460*b* is rotatably coupled to the rear end of left side wall 1423*a* via a pivot screw 1470*b* just like that of pivot screw 170, and can be secured via a set screw 1480*b* just like that of set screw 180. In this regard, pivot pin 1470*b* is engaged to cam lobe 1460*b* and the fourth threaded opening while set screw 1480*b* is engaged to the third threaded opening to secure pivot screw 1470*b* to prevent further rotation of cam lobe 1460*b*. Rotation of such cam lobe 1460*b* adjusts a distance between its lowest point and trigger base 1420 and the respective distance to the internal receiver floor 11, in order to set pre-travel of the trigger assembly 1402. In this regard, the larger the distance, the less pre-travel is required to break trigger sear 1425 and hammer sear 230 engagement. Conversely, the shorter the distance, the more positive angular movement (counter-clockwise from a left side perspective) is required by trigger assembly 1402 to achieve break. As such, cam lobe 1460*b* bears against receiver floor 11 to give trigger assembly 1402 an initial positive angular rotation so that less angular rotation is needed to achieve break.

Trigger assembly 1402 also includes a cantilevered arm 1490 extending upwardly and rearwardly from a rear end of left sidewall 1423*a*. However, cantilevered arm 1490 can extend from left sidewall 1423*b* in other embodiments not shown. A threaded opening extends through arm 1490 in a left-right direction at a free end remote from a fixed end of arm 1490. A forced reset member 1460*c*, which is in the form of a cam lobe, is rotatably coupled to arm 1490 via a threaded fastener 1470*c* similar to that of pivot screw 170, which is secured via a jam nut 1475 to prevent further rotation as desired. In this regard, cam lobe 1460*c* can be rotated to its desired orientation to so that a vertical distance defined between an upper extent of cam lobe 1460*c* and arm 1490 is adjustable to achieve the desired forced reset action. Forced reset is a feature in which an under surface of bolt carrier 18 during cycling contacts a cam surface 1462*c* of cam lobe 1460*c* which forces trigger assembly 1402 to rotate and thereby the fire control group to reset even where a user has not completely released trigger extension 1410 and continues to apply moderate force to it. Thus, the forced reset function cycles the fire control group so that less mechanical dexterity of the user is needed. An alternate embodiment of cantilevered arm 1490 would directly engage the bottom of bolt carrier 18, as to discard the need to utilize an adjustable cam-lobe member 1460*c* and the respective hardware, and might only be preferred for military style applications where moving or adjustable features are detraction to reliability and uniformity. In other words, a forced reset feature (not shown) protruding from the upper tip of arm 1490 may be integrally incorporated into trigger 1404.

Figure 19A:
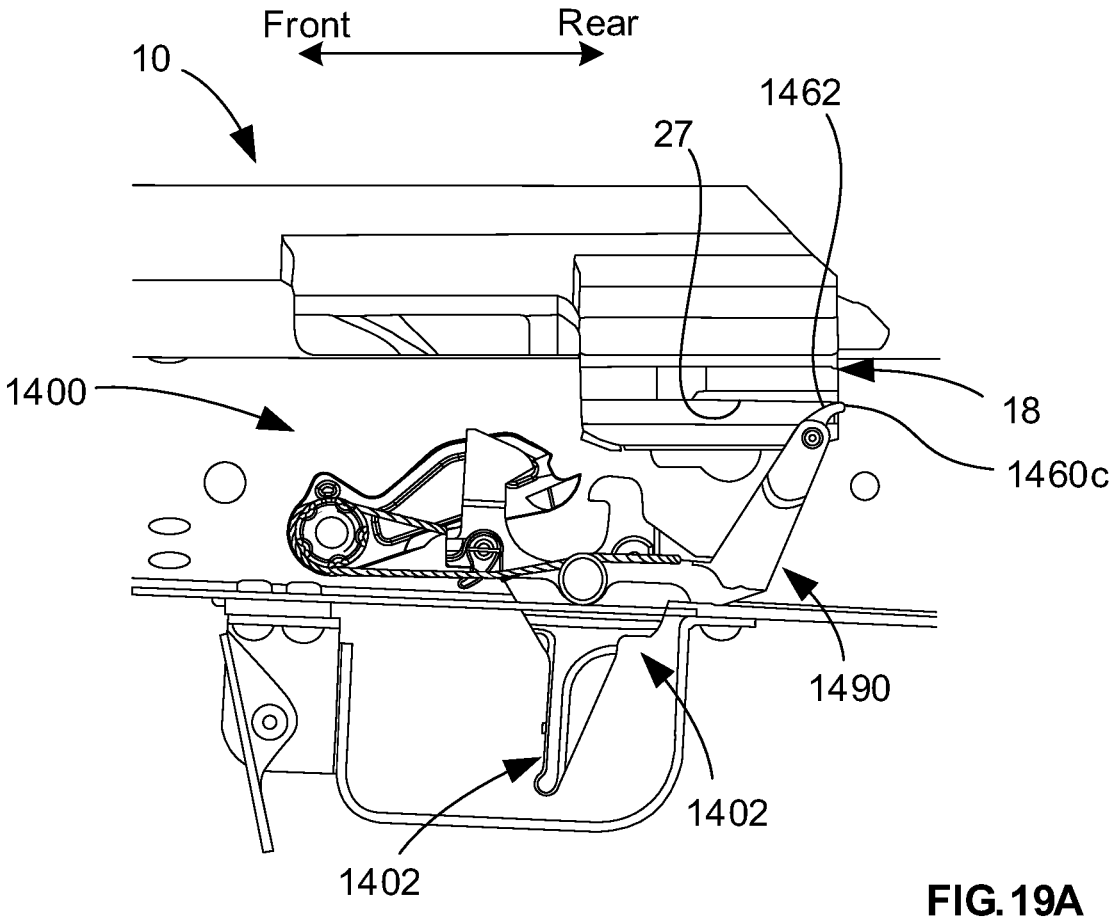
FIG. 19A is a cutaway view of the firearm of FIG. 1A showing a fire control group including the trigger assembly of FIG. 18A assembled thereto.
Figure 19B:
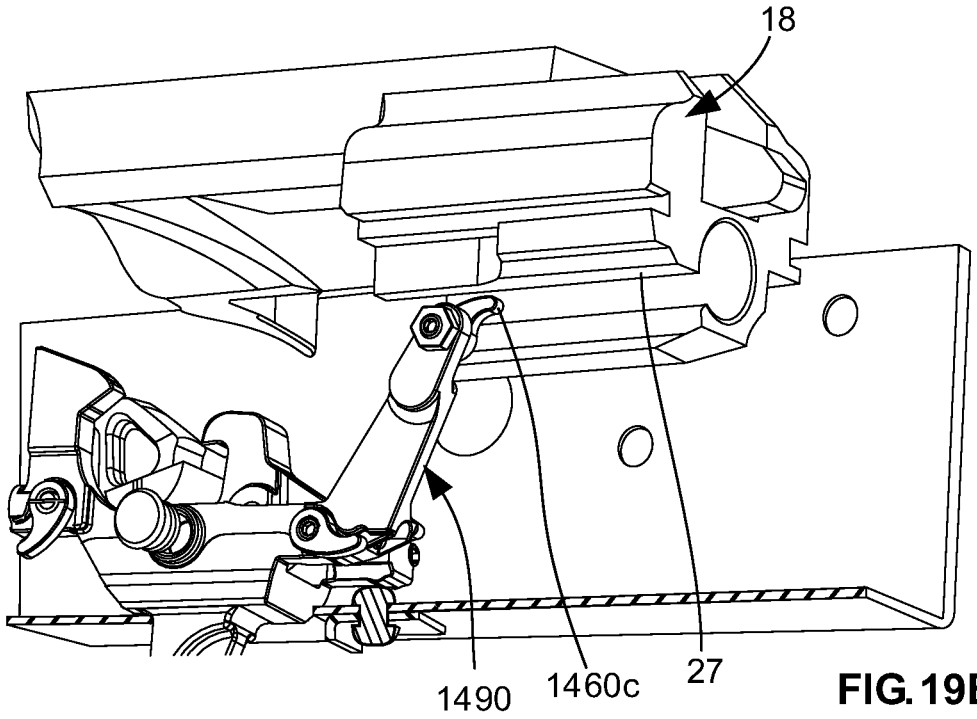
FIG. 19B is another cutaway view of the firearm of FIG. 1A showing a fire control group including the trigger assembly of FIG. 18A assembled thereto.

FIGS. 19A and 19B depicts a fire control group 1400 that includes trigger assembly 1402 assembled within firearm 10 and the operation of the forced-reset of trigger assembly 1402. As shown, after trigger extension 1402 has been pulled to the rear and as the hot gases from a round of ammunition pushes bolt carrier 18 to the rear, bolt carrier 18 engages forced-reset member 1460*c*, as best shown in FIG. 19A. As bolt carrier group 18 continues to advance to the rear, an engagement plane 27 at the left bottom of bolt carrier 18 drives trigger arm 1490 downward which in turn drives trigger extension 1402 forward to reset fire control group 1400, as shown in FIG. 19A. Once bolt carrier 18 has returned to its forward position, trigger extension 1402 can be pulled to the rear again for another cycle of operations. This forced-reset generates a consistent and fast reset of fire control group 1400.

While the foregoing devices are described in conjunction with Kalashnikov-style firearms, it should be understood that the principles described can be utilized in other firearm platforms, such as an AR-15/M4 platform, to provide an adjustable fire control group.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A fire control group system for a firearm, comprising:

a trigger having a trigger base, a trigger extension extending from the trigger base, and an over-travel member coupled to the trigger base at a front end thereof, the trigger base having a sear hook extending therefrom and defining a recess and a transverse bore intersecting the recess, the over-travel member having a contact surface and being moveable relative to the trigger base such that a distance in a vertical direction between the contact surface and the trigger base is adjustable;

a disconnector having a disconnector body and a sear hook extending from the disconnector body, the disconnector body defining a transverse bore extending therethrough and being configured to be received within the recess of the trigger base so that the transverse bores of the trigger base and disconnector align; and a hammer having a spring spool and a hammer body extending from the spring spool, the spring spool defining a transverse bore extending therethrough, the hammer body having a strike face and a sear extending from an end of the hammer body, the sear being configured to engage the sear hooks of the trigger and disconnector when coupled to a receiver of a firearm.

2. The fire control group system of claim 1, wherein the over-travel member is a cam lobe coupled to a side of the trigger base and rotatable about a pivot axis, the cam lobe having cam surface eccentric relative to the pivot axis.

3. The fire control group system of claim 2, wherein the trigger base includes a first threaded opening extending in a first direction and a second threaded opening extending in a second direction transverse to the first direction.

4. The fire control group system of claim 3, further comprising a pivot screw and a set screw, the pivot screw being configured to extend through the cam lobe and into the second threaded opening to allow rotation of the cam lobe about the pivot axis, the set screw being configured to extend into the first opening and into contact with the pivot screw to prohibit rotation of the pivot screw within the second opening.

5. The fire control group system of claim 4, wherein the set screw has a threaded shaft and a nub extending from the threaded shaft, the nub being made of a softer material than the pivot screw.

6. The fire control group system of claim 1, further comprising a safety engagement member and the trigger base includes a safety engagement block extending from the trigger base in a rearward direction, the safety engagement member being connectable to the safety engagement block and moveable in a vertical direction relative thereto.

7. The fire control group system of claim 6, wherein the safety engagement member includes a cross-bar and opposed legs extending from the cross bar, the safety engagement block having a saddle configured to receive the legs in a slidable manner.

8. The fire control group system of claim 6, wherein the safety engagement member is a threaded fastener having a head and a threaded shaft, the safety engagement block defining a threaded opening extending therein in a vertical direction, the threaded shaft of the threaded fastener being configured to engage the threaded opening.

9. The fire control group system of claim 6, wherein the safety engagement member is a cam lobe rotatably coupled to a side of safety engagement block.

10. The fire control group system of claim 1, further comprising a pre-travel member coupled to the trigger base at a rear end thereof, the pre-travel member having a contact surface and being moveable relative to the trigger base such that a distance between the contact surface of the pre-travel member and the trigger base in a vertical direction is adjustable.

11. The fire control group system of claim 10, wherein the pre-travel member is a cam lobe coupled to a side of the trigger base and rotatable about a pivot axis, the cam lobe having cam surface eccentric relative to the pivot axis.

12. The fire control group system of claim 11, wherein the trigger base includes a first threaded opening extending in a first direction and a second threaded opening extending in a second direction transverse to the first direction.

13. The fire control group system of claim 12, further comprising a pivot screw and a set screw, the pivot screw being configured to extend through the cam lobe and into the second threaded opening to allow rotation of the cam lobe about the pivot axis, the set screw being configured to extend into the first opening and into contact with the pivot screw to prohibit rotation of the pivot screw within the second opening.

14. The fire control group system of claim 13, wherein the set screw has a threaded shaft and a nub extending from the threaded shaft, the nub being made of a softer material than the pivot screw.

15. The fire control group system of claim 1, further comprising a forced reset member and the trigger base includes an arm extending from a rear end thereof, the forced reset member having a contact surface and being moveably coupled to the arm such that a distance in a vertical direction between the contact surface of the forced reset member and the arm is adjustable.

16. The fire control group system of claim 15, wherein the forced reset member is a cam lobe coupled to a side of arm and is rotatable about a pivot axis, the cam lobe having a cam surface eccentric relative to the pivot axis.

17. The fire control group system of claim 1, wherein the strike face of the hammer is curved in a plane extending transverse to a length of the hammer body.

18. The fire control group system of claim 17, wherein the hammer body has at least one recess extending into the hammer body at opposing sides thereof and the hammer body has a rib defining a perimeter of the at least one recess.

19. The fire control group system of claim 1, further comprising a pivot pin assembly, the pivot pin assembly having a pivot pin and a first screw, the pivot pin having an expandable head and a shaft extending from the expandable head, the expandable head having a threaded opening, the first screw being configured to be received within the threaded opening so that rotation of the first screw expands the expandable head, the pivot pin shaft being configured to be received within the transverse bores of the trigger base and disconnector body and/or the transverse bore of the hammer.

20. The fire control group system of claim 19, further comprising a second screw, wherein the pivot pin shaft has an expandable end and has a threaded opening extending within the expandable end, the second screw being configured to be received within the threaded opening so that rotation of the first screw expands the expandable end.

* * * * *